US009080274B2

(12) United States Patent
Kim et al.

(10) Patent No.: US 9,080,274 B2
(45) Date of Patent: Jul. 14, 2015

(54) WASHING METHOD AND WASHING MACHINE

(75) Inventors: Changoh Kim, Seoul (KR); Jaehyun Kim, Seoul (KR); Jaewon Chang, Seoul (KR); Jongmin Lee, Seoul (KR); Sangheon Lee, Seoul (KR); Youngho Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 806 days.

(21) Appl. No.: 12/976,361

(22) Filed: Dec. 22, 2010

(65) Prior Publication Data

US 2011/0146002 A1 Jun. 23, 2011

(30) Foreign Application Priority Data

Dec. 23, 2009 (KR) ..... 10-2009-0130102
Dec. 23, 2009 (KR) ..... 10-2009-0130104
Dec. 23, 2009 (KR) ..... 10-2009-0130105
Dec. 24, 2009 (KR) ..... 10-2009-0130968

(51) Int. Cl.

*D06F 35/00* (2006.01)
*D06F 33/02* (2006.01)
*D06F 39/00* (2006.01)
*D06F 39/08* (2006.01)

(52) U.S. Cl.

CPC ..... *D06F 35/006* (2013.01); *D06F 33/02* (2013.01); *D06F 35/007* (2013.01); *D06F 39/003* (2013.01); *D06F 39/083* (2013.01); *D06F 39/088* (2013.01)

(58) Field of Classification Search

CPC ..... D06F 35/006; D06F 35/007
USPC ..... 68/13 R, 23.5, 17 R, 18 R
See application file for complete search history.

(56) References Cited

U.S. PATENT DOCUMENTS 2,432,766 A 12/1947 Kirby
3,811,300 A 5/1974 Barton et al.
4,489,574 A * 12/1984 Spendel ..... 68/16
5,191,667 A * 3/1993 Roy et al. ..... 8/158
5,191,668 A 3/1993 Euler et al.
5,191,669 A 3/1993 Euler et al.
5,219,370 A 6/1993 Farrington et al.

(Continued)

FOREIGN PATENT DOCUMENTS

DE 39 09 021 A1 9/1990
DE 40 13 450 A1 10/1991

(Continued)

OTHER PUBLICATIONS

Machine Translation of Schellenberg, EP 1700943 A1, Sep. 2006.*

*Primary Examiner* — David Cormier
(74) *Attorney, Agent, or Firm* — McKenna Long & Aldridge LLP

(57) ABSTRACT

Provided are a washing method and washing machine. According to an aspect of the present invention, there is provided a washing method including: performing an eco-rinsing process where a drum rotates in a state where at least a portion of a laundry is pressed against an inner wall of the drum and wash water is sprayed into the drum; performing an intermediating process for reducing an RPM of the drum to an RPM at which at least a portion of the laundry is pressed against an inner wall of the drum; and performing an eco-rinsing process where the drum is accelerated and the wash water is sprayed into the drum.

11 Claims, 15 Drawing Sheets

(56) References Cited

U.S. PATENT DOCUMENTS

| | | | | |
|---|---|---|---|---|
| 5,439,019 | A | 8/1995 | Quandt et al. | |
| 5,689,846 | A | 11/1997 | Cheyne et al. | |
| 2001/0047670 | A1* | 12/2001 | Whah et al. | 68/12.02 |
| 2003/0154558 | A1* | 8/2003 | Pyo et al. | 8/158 |
| 2005/0166334 | A1 | 8/2005 | Clouser | |
| 2009/0165218 | A1* | 7/2009 | Son et al. | 8/159 |
| 2009/0183319 | A1 | 7/2009 | Chai et al. | |

FOREIGN PATENT DOCUMENTS

| | | | |
|---|---|---|---|
| DE | 4210577 | A1 | 10/1993 |
| DE | 42 36 873 | A1 | 5/1994 |
| DE | 196 41 309 | A1 | 4/1998 |
| DE | 19908804 | A1 | 9/2000 |
| EP | 0 962 577 | A1 | 12/1999 |
| EP | 1 063 341 | A2 | 12/2000 |
| EP | 1700943 | A1 * | 9/2006 |
| EP | 1983088 | A1 | 10/2008 |
| EP | 2042645 | A1 | 4/2009 |
| EP | 2287378 | A1 | 2/2011 |
| GB | 2 219 603 | A | 12/1989 |
| JP | H07-299284 | | 11/1995 |
| JP | 2002-035468 | | 2/2002 |
| JP | 2002-136793 | | 5/2002 |
| JP | 2007-105212 | | 4/2007 |
| JP | 2007-215588 | | 8/2007 |
| JP | 2008-126139 | | 6/2008 |
| JP | 4-143321 | | 9/2008 |
| JP | 2008-237441 | | 10/2008 |
| JP | 2009-039435 | | 2/2009 |
| JP | 2009-273764 | | 11/2009 |
| KR | 10-0881527 | | 1/2009 |
| WO | WO 2009/138529 | A1 | 11/2009 |
| WO | 2009/148271 | A2 | 12/2009 |

* cited by examiner

WASHING METHOD AND WASHING MACHINE

This application claims priority from Korean Patent Application No. 10-2009-0130102 filed on Dec. 23, 2009, No. 10-2009-0130104 filed on Dec. 23, 2009, No. 10-2009-0130105 filed on Dec. 23, 2009, and No. 10-2009-0130968 filed on Dec. 24, 2009 in the Korean Intellectual Property Office, the disclosures of which are incorporated herein by reference in their entirety.

BACKGROUND OF THE INVENTION

1. Field of the Invention

Embodiments relate to a washing method and washing machine, and more particularly, to a washing method and washing machine with shorter washing time and improved washing performance.

2. Description of the Related Art

In general, a washing machine is an apparatus that uses water, detergent, and mechanical action to wash clothing, bed linen, etc. (hereinafter referred to as 'laundry') by performing wash, rinse, and spin cycles to remove contaminants from the laundry.

Washing machines are categorized into agitator type, pulsator type, and drum type washing machines.

An agitator type washing machine performs washing by left and right rotation of a washing agitator projecting upward in the center of a wash tub, a pulsator type washing machine performs washing by employing friction between whirling water and laundry through rotating left and right a round plate shaped rotating wing formed on the bottom of a wash tub, and a drum type washing machine performs washing by rotating a drum filled with water, detergent, and laundry.

A drum washing machine has a tub installed inside a cabinet defining the exterior of the washing machine to hold wash water, a drum disposed inside the tub to hold laundry, a motor installed at the rear side of the tub to rotate the drum, and a driveshaft installed on the motor, passed through the tub, and connected to the reverse side of the drum. A lifter is installed within the drum to lift laundry when the drum rotates.

Various efforts are being made to improve the washing performance of such drum washing machines.

BRIEF DESCRIPTION OF THE DRAWINGS

Embodiments can be understood more fully from the following detailed description in conjunction with the accompanying drawings.

DETAILED DESCRIPTION OF THE INVENTION

Figure 1:
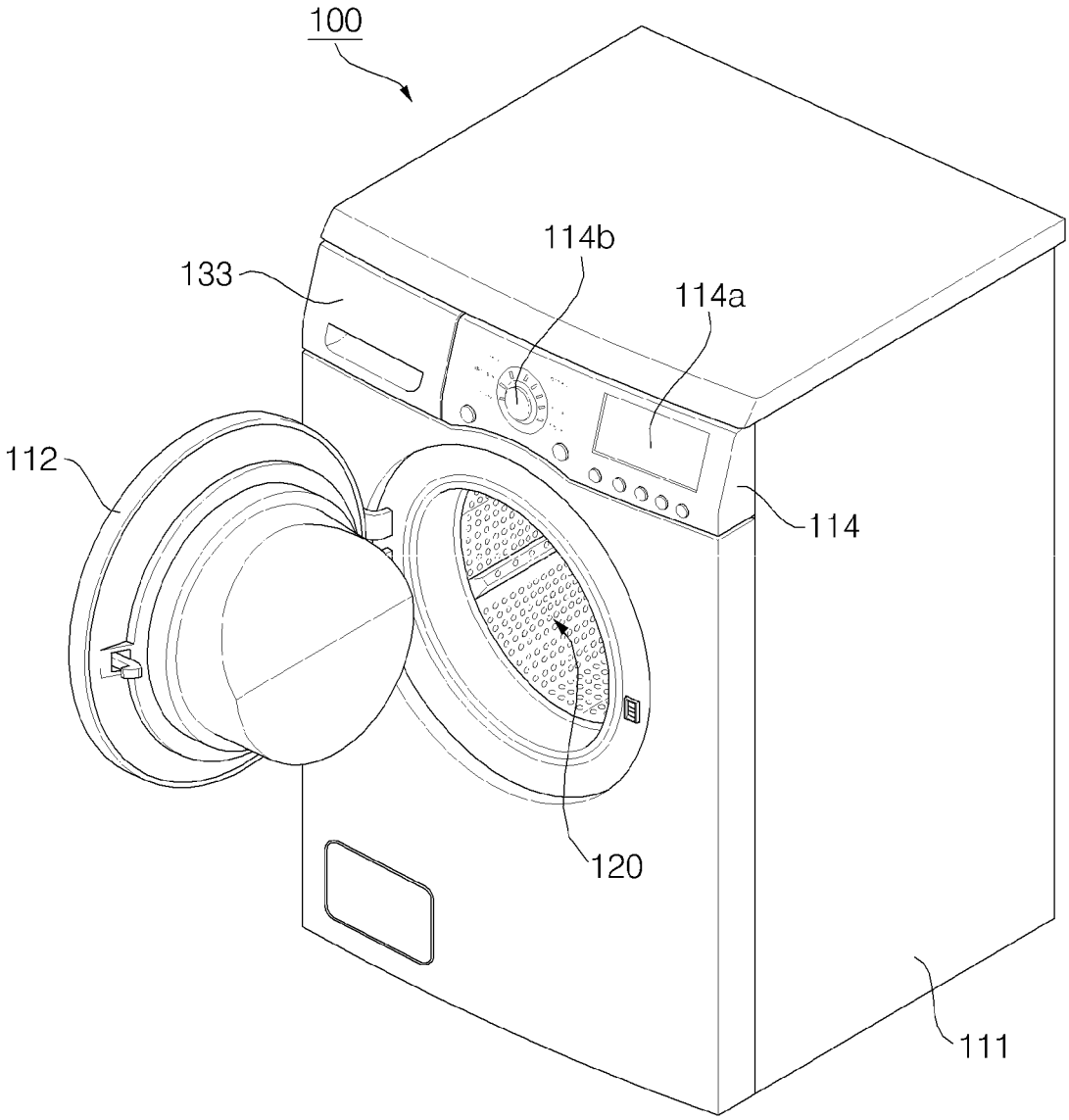
FIG. 1 is a perspective view illustrating a washing machine according to an embodiment of the present invention.

The foregoing and other objects, features, aspects and advantages of the present invention will become more apparent from the following detailed description of the present invention when taken in conjunction with the accompanying drawings. Exemplary embodiments of the present invention will now be described in detail with reference to the accompanying drawings. The invention may, however, be embodied in many different forms and should not be construed as being limited to the embodiments set forth herein. Rather, these embodiments are provided so that this disclosure will be thorough and complete, and will fully convey the scope of the invention to those skilled in the art. In the drawings, the shapes and dimensions may be exaggerated for clarity, and the same reference numerals will be used throughout to designate the same or like components.

Hereinafter, exemplary embodiments of the present invention will be described in detail with reference to the accompanying drawings.

Figure 2:
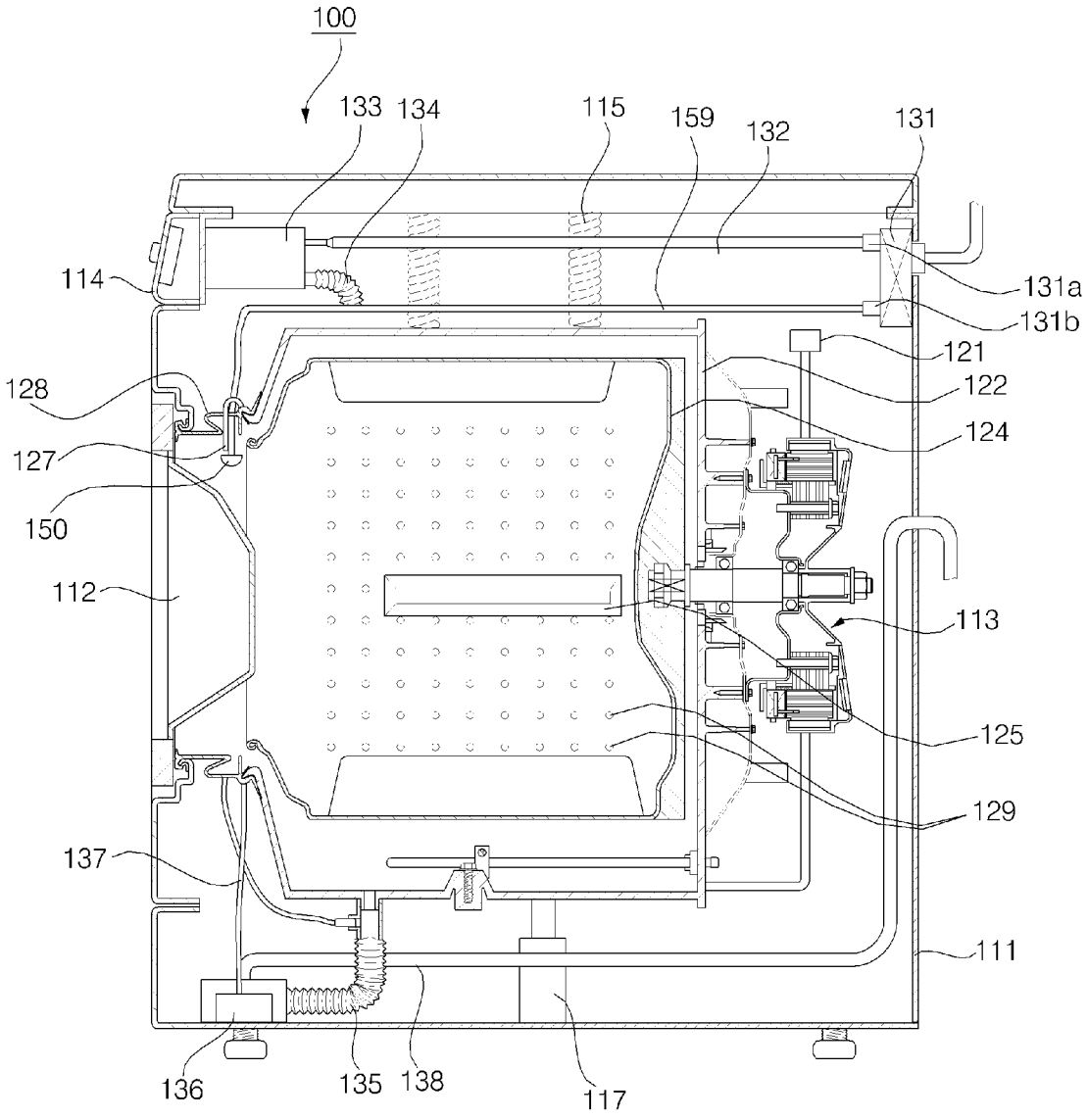
FIG. 2 is a cross-sectional view illustrating the washing machine of FIG. 1.
Figure 3:
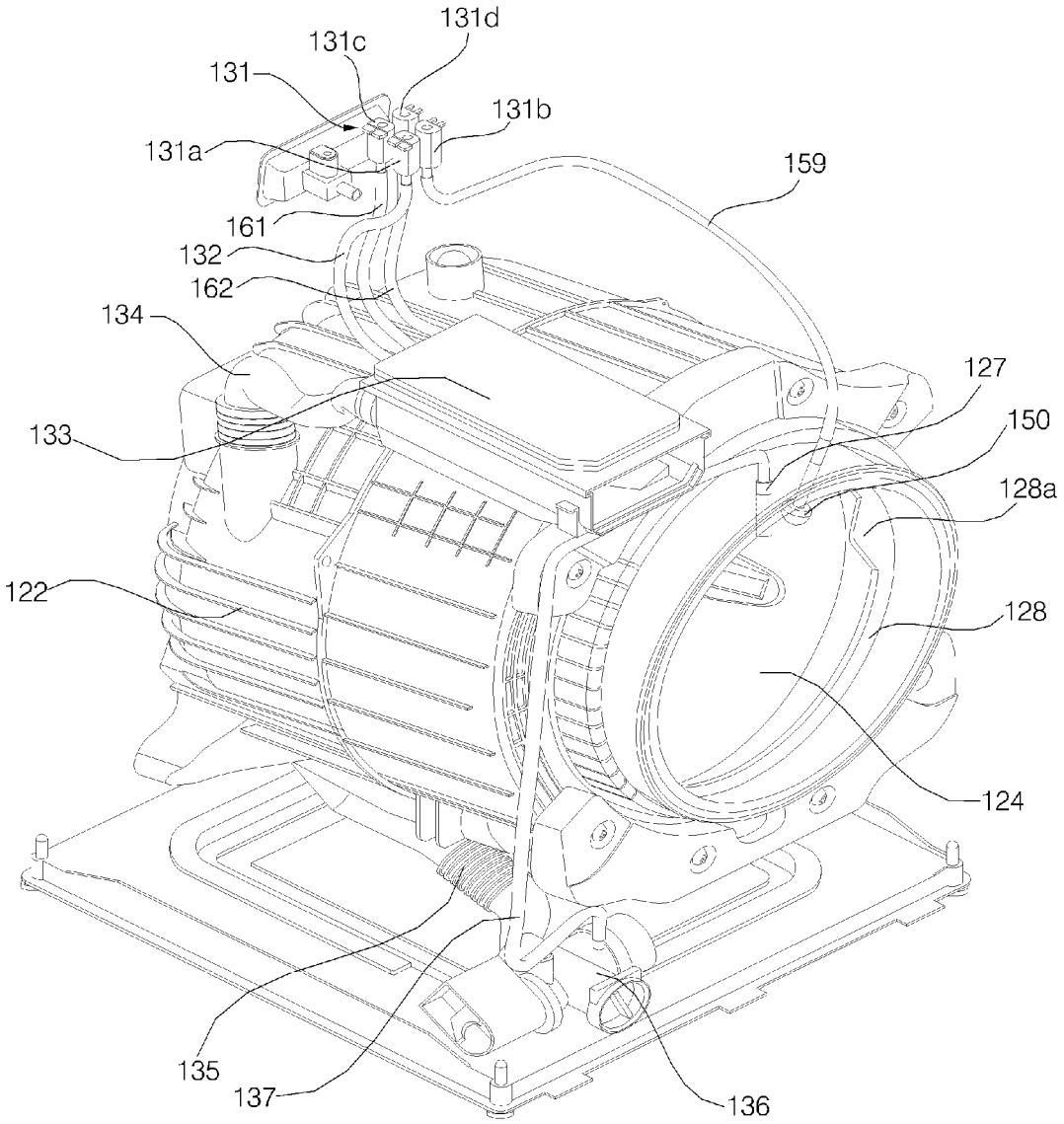
FIG. 3 is a view illustrating the internal structure of the washing machine of FIG. 1.

FIG. 1 is a perspective view illustrating a washing machine according to an embodiment of the present invention. FIG. 2 is a cross-sectional view illustrating the washing machine of FIG. 1. FIG. 3 is a view illustrating the internal structure of the washing machine of FIG. 1.

A washing machine 100 according to an embodiment of the present invention includes a cabinet 111 defining the exterior, a door 112 opening and closing one side of the cabinet 111 such that laundry is introduced into the cabinet 111, a tub 122 disposed inside the cabinet 111 and supported by the cabinet 111, a drum 124 disposed in the tub 122 and rotating with laundry inserted, a driving unit 113 that applies torque to rotate the drum 124, a detergent box 133 for holding detergent, and a control panel 114 that receives a user input and displays the state of the washing machine 100.

The cabinet 111 defines the laundry loading hole 120 to enable loading of laundry. The door 112 is pivotably provided on the front surface of the cabinet 111 to open and close the laundry loading hole 120. The control panel 114 is provided on the cabinet 111 to receive a command from a user and display information on various aspects of the washing machine 100. The detergent box 133 is provided on the cabinet 111 to be insertable and withdrawable and hold detergent such as washing detergent, rinsing detergent, and bleach.

The tub 122 is disposed in the cabinet 111 to be cushioned by a spring 115 and a damper 117. The tub 122 holds wash water. The drum 124 is disposed inside the tub 122.

A level sensor 121 may be provided in the tub to sense the water level of wash water held in the tub 122. The level sensor 121 may be implemented in various methods. In the present embodiment, the level sensor 121 measures the water level using a capacitance variation of an electrode caused by changing a gap between electrodes using an air pressure varying according to the level of wash water.

The drum 124 holds laundry and rotates. The drum 124 defines a plurality of through-holes 129 to allow wash water to pass therethrough. A lifter 125 may be disposed on the inner wall of the drum 124 to lift laundry a certain height when the drum 124 rotates. The drum 124 receives rotating force from the driving unit 113 to rotate.

The gasket 128 is provided between the tub 122 and the cabinet 111 to seal the tub 122 and cabinet 111. The gasket 128 is disposed between the entrance of the tub 122 and the laundry loading hole 120. The gasket 128 absorbs shock transmitted to the door 112 when the drum 124 rotates, and also prevents wash liquid from within the tub 122 from leaking to the outside. A first nozzle 127 and a second nozzle 150 may be provided on the gasket 128 to introduce wash water into the drum 124.

The gasket 128 is formed integrally of a single material, and may be formed of a robust material at the portion coupled to the tub 122, in order to ensure adequate fastening strength with the tub 122 and rigidity. The portion that couples to the cabinet 111 may be formed of a material having elasticity to absorb vibrations transferred from the tub 122 to the cabinet 111.

The driving unit 113 rotates the drum 124. The driving unit 113 may rotate the drum 124 at various speeds or different directions. The driving unit 113 may include a motor and a switching device for controlling the motor, a clutch, etc.

The detergent box 133 holds detergent such as washing detergent, rinsing detergent, and bleach. The detergent box 133 may be provided to be withdrawable to the front of the cabinet 111. The detergent in the detergent box 133 is mixed with wash water and enters the tub 122 when wash water is supplied. The detergent box 133 may be divided into a portion that holds washing detergent, a portion that holds ringing detergent, and a portion that holds bleach.

The inside of the cabinet 111 may include a water supply valve unit 131 for controlling the influx of wash water from an external water source, a first water supply hose 132 guiding wash water to the detergent box 133 when a first water supply valve 131*a* is opened, and a water supply hose 134 that allows wash water mixed with detergent to flow from the detergent box 133 into the tub 122. Also, a second water hose 159 may be provided to be connected to a second nozzle 150 such that wash water without detergent, directly supplied from the external water source when a second water supply valve 131*b* of the water supply valve unit 131 is opened, is sprayed into the drum 124.

A third water supply hose 161 is provided inside the cabinet 111 to guide wash water to the detergent box 133 when the prevalve 131*c* of the water supply valve unit 131 is opened. Wash water flowing into the detergent box 133 through the third water supply hose 161 is not mixed with detergent and flows into the tub 122 through the water supply pipe 134. Also, a fourth water supply hose 162 is provided inside the cabinet 111 to guide wash water to the detergent box 133 when the bleach valve 131*d* of the water supply valve unit 131 is opened. Wash water flowing into the detergent box 133 through the fourth water supply hose 162 is mixed with bleach and flows into the tub 122 through the water supply pipe 134.

The inside of the cabinet 111 may include a drain pipe 135 through which wash water inside the tub 122 is drained, a pump 136 for draining wash water in the tub 122, a circulation hose 137 that circulates wash water, a circulation nozzle 127 for directing flow of wash water into the drum 124, and a drain hose 138 for draining wash water to the outside. According to embodiments, the pump 136 may be provided as a circulation pump and a drain pump connected to the circulation hose 137 and the drain hose 138, respectively.

The control panel 114 may include an input unit 114*b* through which a washing course selection, operating times for each cycle, presettings, and various other operating commands are input by a user, and a display unit 114*a* that displays the operating state of the washing machine 100.

The washing course includes, in addition to a normal course, various courses according to the type or function of laundry, such as a lingerie/wool course, a steam course, a quick wash course, a functional garment course, a gentle course to prevent damage to laundry, a silent course, and an energy-saving course. The operations of the washing machine 100 are divided into a wash cycle, a rinse cycle, and a spin cycle, and in each cycle, supplying water, washing, rinsing, draining, spinning, and/or drying are performed.

The first nozzle 127 is provided at the gasket 128 to spray wash water into the drum 124. The first nozzle 127 is connected to the circulation hose 137 to spay wash water that the pump 136 has circulated into the drum 124.

The wash water housed in the drum 124 moves along the drain pipe 135 provided on the tub 122 to the pump 136. The pump 136 moves wash water through the circulation passage 137 to the first nozzle 127. The wash water flows back into the drum 124 by means of the first nozzle 127.

The first nozzle 127 may be provided at an upper portion of the gasket 128. According to embodiments, the first nozzle 127 may be disposed at various locations such as a lower portion of the gasket 128, a location between the gasket 128 and the cabinet 111, the cabinet 111, and the tub 122.

The second nozzle 150 is provided at the gasket 128 to spray wash water into the drum 124. The second nozzle 150 is provided adjacent to the first nozzle 127. The second nozzle 150 is connected to the second water supply hose 159 to spray wash water supplied from the external water source into the drum.

The second nozzle 150 may be provided at the upper portion of the gasket 128. According to embodiments, the first nozzle 150 may be disposed at various locations such as the lower portion of the gasket 128, a location between the gasket 128 and the cabinet 111, the cabinet 111, and the tub 122.

The first nozzle 127 and/or the second nozzle 150 may be a whirling nozzle that revolves and discharges wash water to the inner wall 124*a* and rear wall 124*b* of the drum 124.

A whirling nozzle is a nozzle that allows wash water to undergo a translational motion and a circular motion. The whirling nozzle may be embodied in various forms, and may change wash water into whirling water to spray into the drum 124 via a plurality of twisted passages.

It has been described that the first nozzle 127 and the second nozzle 150 are connected to the circulation hose 137 and the second water supply hose 159, respectively, but the spirit and scope of the present invention are not limited thereto. The first and second nozzles 127 and 150 may connected to the circulation hose 137 and the second water supply hose 159 in various combinations.

According to embodiments, the second nozzle 150 may be provided integrally with first nozzle 127. That is, one whirling nozzle may be configured to serve as the first nozzle 127 and the second nozzle 150. The whirling nozzle may be connected to the second water supply hose 149 and the circulation hose 137 through a Y-shaped pipe to spray wash water supplied from the external water source or wash water that is circulated. Also, the water supply pipe 134 may be a whirling nozzle that is formed integrally with the first nozzle 127 and/or the second nozzle 150.

The water supply valve unit 131 controls the influx of wash water from an external water source. The water supply valve unit 131 includes a first water supply valve 131*a*, a second water supply valve 131*b*, a prevalve 131*c*, and a bleach valve 131*d*. The water supply valve unit 131 may further include a hot water valve (not shown) and a steam valve (not shown).

The first water supply valve 131*a* supplies wash water into the detergent box 133 through the first water supply hose 132. Wash water supplied by the first water supply valve 131*a* is mixed with washing detergent while passing a portion of the detergent box 133 holding washing detergent, and then is supplied into the tub 122 through the water supply pipe 134.

The second water supply valve 131*b* supplies wash water to the second nozzle 150 through the second water supply hose 159. Wash water supplied by the second water supply valve 131*b* is sprayed into the drum 124 through the second nozzle 150.

The prevalve 131*c* supplies wash water to the detergent box 133 through the third water supply hose 161. Wash water supplied by the prevalve 131*c* is not mixed with washing detergent in the detergent box 133, and is supplied into the tub 122 through the water supply pipe 134.

The bleach valve 131*d* supplies wash water to the detergent box 133 through the fourth water supply hose 162. Wash water supplied by the bleach valve 131*d* is mixed with bleach in the detergent box 133 and is supplied into the tub 122 through the water supply pipe 134.

The hot water valve supplied hot water to the detergent box 133 by controlling hot water supplied from the external water source. The steam valve supplies wash water to a steam hose (not shown) connected to a steam module (not shown) to allow the steam module to supply steam into the drum 124.

Each of the above valves may, according to embodiments, be combined with two or more to perform the respective functions. Any one of the above described valves may function as the first water supply valve 131*a* or the second water supply valve 131*b*, and a combination of two or more valves may function as the first water supply valve 131*a* and the second water supply valve 131*b*. Any one of the hoses connected to the respective valves and to the detergent box 133 may function as the first water supply hose 132 or the second water supply hose 159.

The first water supply hose 132 connects the first water supply valve 131*a* and the detergent box 133. The wash water supplied from the external water source through the first water supply valve 131*a* reaches the detergent box 133 through the first water supply hose 132, and the wash water mixed with detergent in the detergent box 133 flows through the water supply pipe 134 into the tub 122.

A whirling nozzle may be provided on the water supply pipe 134, in which case revolving wash water is discharged through the water supply pipe 134.

The second water supply hose 159 connects the second water supply valve 131*b* to the second nozzle 150. The wash water supplied from an external water supply source flows through the second water supply hose 159 and reaches the second nozzle 150. The wash water that reaches the second nozzle 150 is changed to whirling water through the second nozzle 150 and is sprayed into the drum 124.

The circulation hose 137 connects the pump 136 to the first nozzle 127. The wash water discharged from the tub 122 by the pump 136 flows through the circulation hose 137 and is sprayed into the drum 124 at the first nozzle 127.

Figure 4:
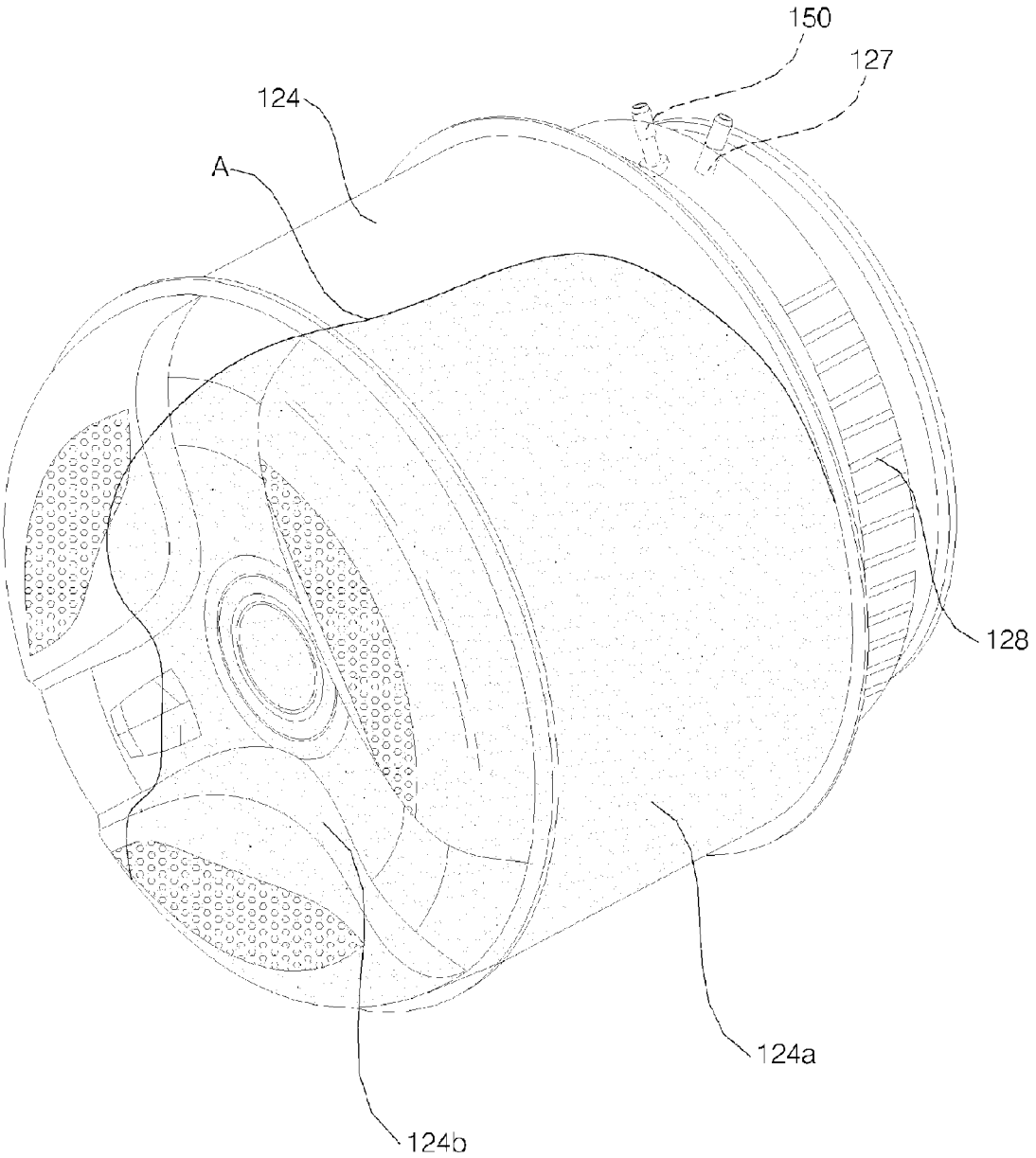
FIG. 4 is a view illustrating a region covered by wash water sprayed by a first nozzle or second nozzle of a washing machine according to an embodiment of the present invention.

FIG. 4 is a view illustrating a region covered by wash water sprayed by a first nozzle or second nozzle of a washing machine according to an embodiment of the present invention.

The first nozzle 127 or the second nozzle 150 allow wash water to be sprayed to a region A of the inner wall 124*a* and rear wall 124*b*. The wash water sprayed from the first nozzle 127 or the second nozzle 150 may reach the region A of the inner wall 124*a* of the drum corresponding to the circumferential wall of the drum 124 and the rear wall 124*b* corresponding to the bottom wall of the drum 124. When laundry is housed in the drum and rotates, the wash water sprayed from the first nozzle 127 or the second nozzle 150 is applied to the laundry in the region A.

The first nozzle 127 or the second nozzle 150 may spray wash water on the entire inner wall 124*a* of the drum 124 and a portion of the rear wall 124*b*, and may spray wash water on the entire inner wall 124*a* of the drum 124 and the entire rear wall 124*b*.

As a whirling nozzle that revolves and discharges wash water, the first nozzle 127 and/or the second nozzle 150 changes wash water to whirling water that moves in a translational motion and a circular motion.

Through centrifugal force imparted by the whirling water, the wash water is sprayed and may be sprayed on the inner wall 124*a* of the drum 124 and the rear wall 124*b*. Also, through the centrifugal force imparted by the whirling water, wash water may be atomized to be quickly absorbed by laundry and pass through.

Figure 5:
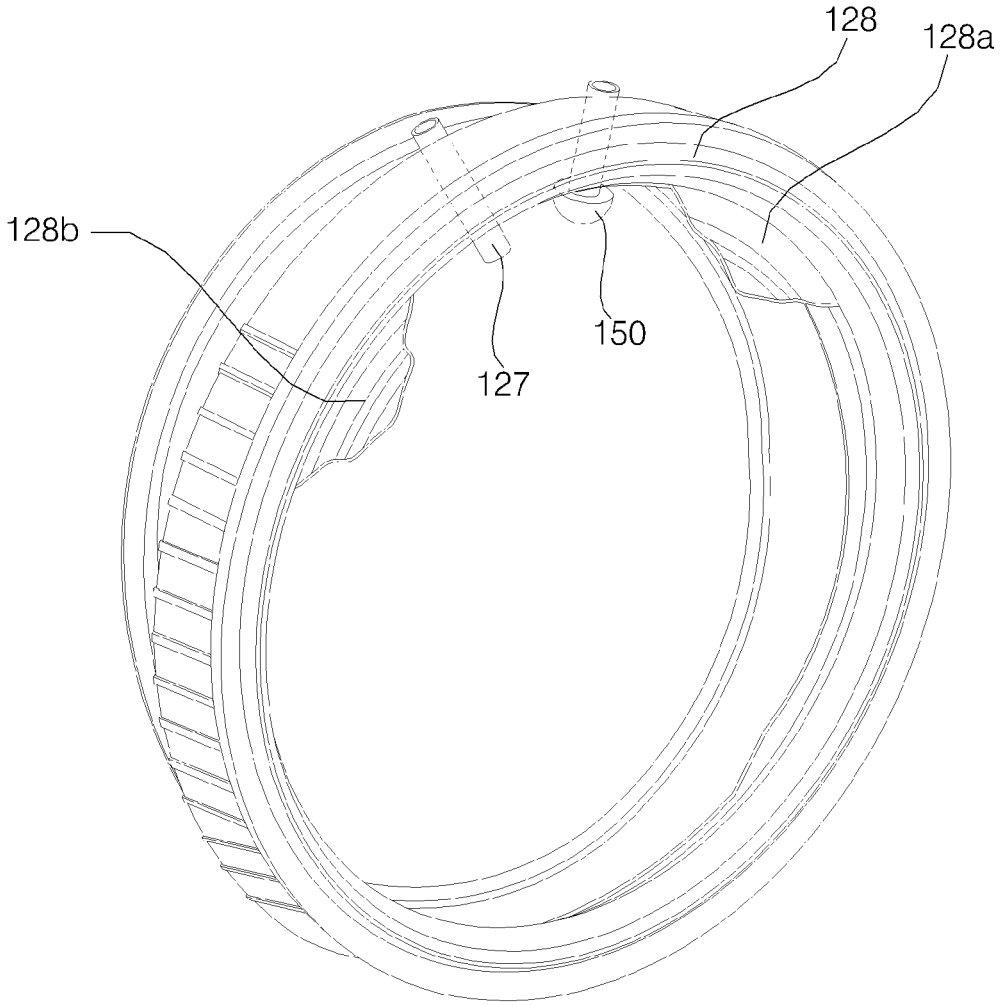
FIG. 5 is a view illustrating a gasket, and a first nozzle and a second nozzle of a washing machine according to an embodiment of the present invention.

FIG. 5 is a view illustrating a gasket, and a first nozzle and a second nozzle of a washing machine according to an embodiment of the present invention.

Referring to FIG. 5, the first nozzle 127 and the second nozzle 150 may be provided at the upper portion of the inner circumferential surface of the gasket 128 to efficiently spray wash water into the drum 124.

In order to prevent laundry from disengaging and wedging between the gasket 128 and cabinet 111 through the rotation of the drum 124, or laundry from spilling out when the door 112 is opened after washing is complete, the first projecting portion 128*a* and the second projecting portion 128*b* are formed protruding from an upper portion of the inner surface of the gasket 128. The first nozzle 127 and the second nozzle 150 are provided between the first projecting portion 128*a* and the second projecting portion 128*b* such that the wash water is not impeded by the first projecting portion 128*a* and the second projecting portion 128*b* when wash water is sprayed.

When the door 112 closes the laundry loading hole 120, a portion of the door 112 enters the drum 124. The first nozzle 127 and the second nozzle 150 is disposed so as not to interfere with the portion of the door 112 that enters the drum 124. When the door 112 closes the laundry loading hole 120, the first nozzle 127 and the second nozzle 150 is provided at a predetermined space from the door 112.

The first nozzle 127 and the second nozzle 150 may be disposed at a position offset from the centerline of the drum 124. When the first nozzle 127 and the second nozzle 150 are positioned offset from the centerline of the drum 124, and when wash water is sprayed, the wash water may act upon the entire inner wall 124*a* of the drum 124 and a portion of the rear wall 124*b*, or the wash water may act upon the entire inner wall 124*a* of the drum 124 and the entire rear wall 124*b*.

The first nozzle 127 or the second nozzle 150 may be disposed to face the inner side of the drum 124. That is, the first nozzle 127 or the second nozzle 150 may be located at a certain angle with respect to the centerline of the drum 124 in a direction of the inner side of the drum 124.

Also, the first nozzle 127 or the second nozzle 150 may be disposed to incline toward the first projecting portion 128*a* or the second projecting portion 128*b*. That is, the first nozzle or the second nozzle 150 may be located at a certain angle with respect to the centerline of the drum.

As described above, the location of the first nozzle 127 or the second nozzle 150 is not limited to the present embodiment, but the first nozzle 127 or the second nozzle 150 may be disposed at various location such as a lower portion of the gasket, a location between the gasket 128 and the cabinet 111, the cabinet 111, and the tub 122.

Figure 6:
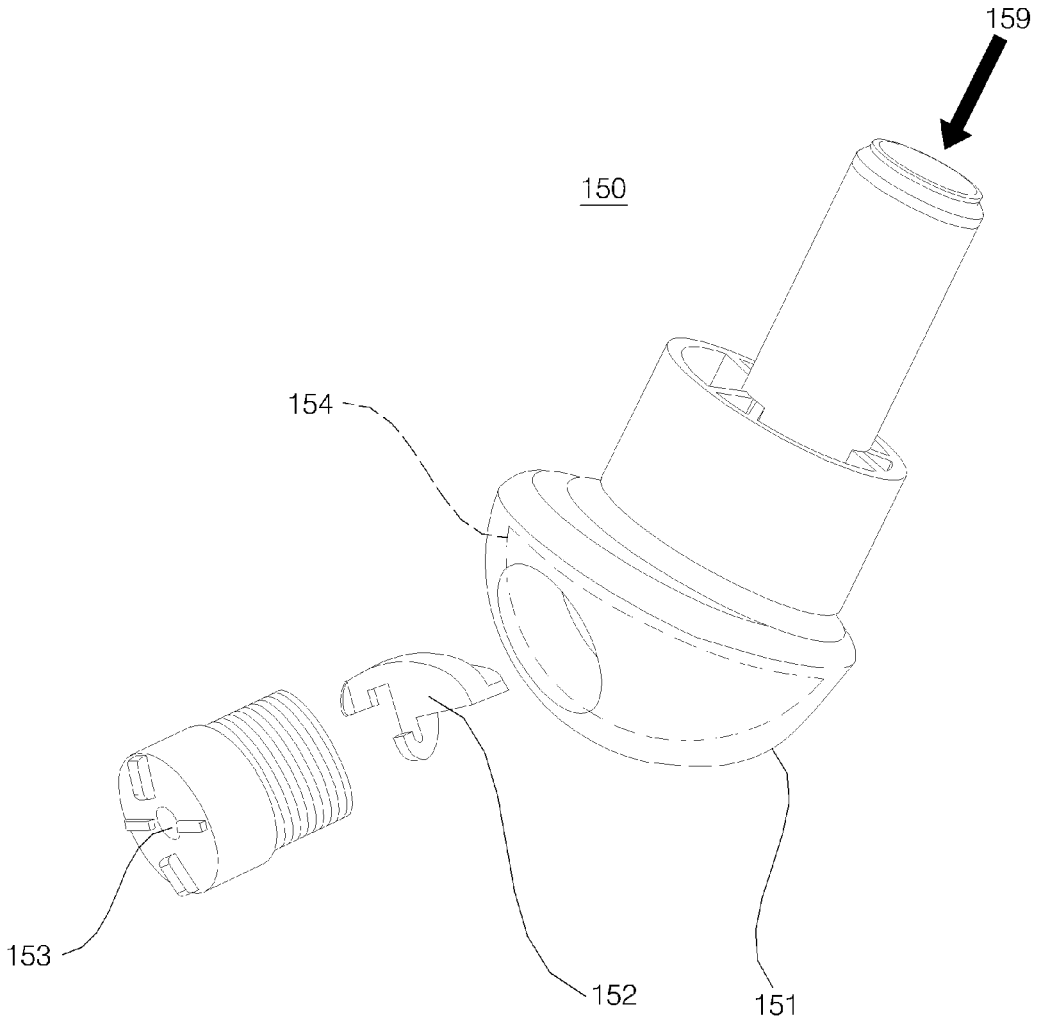
FIG. 6 is an exploded perspective view illustrating a second nozzle of a washing machine according to an embodiment of the present invention.

FIG. 6 is an exploded perspective view illustrating a second nozzle of a washing machine according to an embodiment of the present invention.

Referring to FIG. 6, a second nozzle 150 has one side formed in a hemispherical shape, to include a dome 141 defining a receiving space 154 within, a core 152 with a plurality of bent plates formed in the receiving space 154 to form twisted passages together with the receiving space 154, and a spray nozzle cap 153 that sprays wash water passing through the passages defined by the core 152 and the receiving space 154.

In the present embodiment, the second nozzle 150 is a whirling nozzle including the dome 151, core 152, and spray nozzle cap 153.

The dome 151 is formed in a curved shape that forms a hemisphere or an oval to define the receiving space 154 that is a vacant space therein. The dome 151 is connected to a second water supply hose 159. Wash water flowing through the second water supply hose 159 is housed in the receiving space 154. The dome 151 is formed in a curved shape, so that when laundry is inserted into the laundry loading hole 120, the laundry is not damaged from catching on the second nozzle 150 or by the second nozzle 150.

The core 152 formed with the bent plate is provided in the receiving space 154. The core 152 is formed with one or a plurality of bent plates. The core 152 is provided in the receiving space 154, a passage is defined between the receiving space 154 and the core 152, and because the passage is formed in the shape of the bent plate, a plurality of twisted shapes or screw shapes is formed. The core 152, according to embodiments, may be configured in various shapes that form the receiving space 154 and twisted passage, and may be configured in many types of formations including screws, propellers, twisted tubes, twisted propellers, twisted screws, screw threads, etc.

When wash water passes through a passage of the core 152 and the receiving space 154, it is changed to revolving wash water by means of the passage shape. While the core 152 may generally be fixed, when wash water passes through the passage formed by the core 152 and receiving space 154, the core 152 may be rotated within the receiving space 154 by wash water. When the core 152 is rotated, the wash water also rotates to aid in better forming whirling water.

Upon rotation of the drum 124, the second nozzle 150 may spray wash water on the entire inner wall 124*a* of the drum 124 and a portion of the rear wall 124*b*, and may spray wash water on the entire inner wall 124*a* of the drum 124 and the entire rear wall 124*b*. The wash water sprayed from the second nozzle 150 is sprayed in a whirling form, and the wash water may be atomized to be absorbed by and penetrate the laundry quickly.

The spray nozzle cap 153 sprays wash water that passes through the passage formed by the core 152 and receiving space 154. The spray nozzle cap 153 defines an opening to spray wash water changed by the passage to whirling water into the drum 124. The spray nozzle cap 153 is fastened to the dome 151 and fixed. When the spray nozzle cap 153 is fixed to the dome 151, in order to prevent wash water from leaking out from the coupling portion of the spray nozzle cap 153 and dome 151, packing (not shown) formed of a waterproof material such as rubber may be additionally provided.

While in the present embodiment, description of the second nozzle 150 has been limited to a whirling nozzle, it is not limited thereto, and the second nozzle 150 may be configured in a variety of types of whirling nozzles for revolving and spraying wash water. Also, the second nozzle 150 may be a nozzle that can spray wash water in the shape of FIG. 7 described below or other various shapes.

Figure 7:
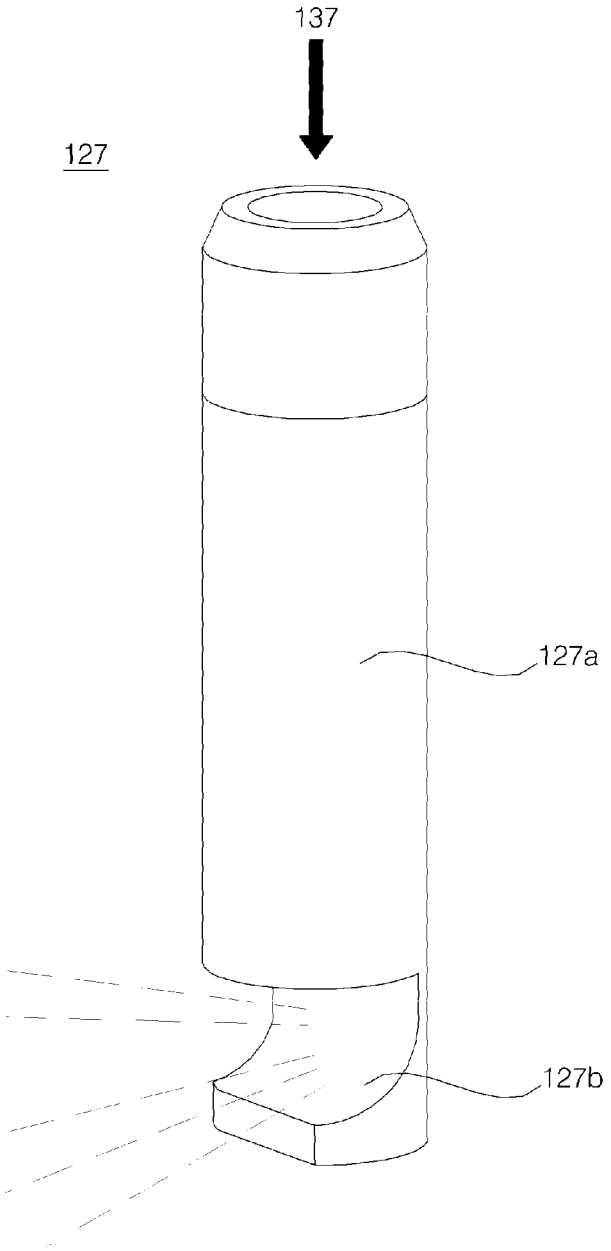
FIG. 7 is a perspective view illustrating a first nozzle of a washing machine according to an embodiment of the present invention.

FIG. 7 is a perspective view illustrating a first nozzle of a washing machine according to an embodiment of the present invention.

Referring to FIG. 7, a first nozzle 127 includes a main body 127*a* having a passage through which wash water passes, and a bent surface 127*b* which wash water having passed the main body 127*a* runs against and is bent to be sprayed from.

The main body 127*a* may be formed to have a cylindrical shape and may pass wash water. The main body 127*a* is connected to the circulation hose 137 and passes wash water flowing from the circulation hose 137. The bent surface 127*b* may be extended from an opening of the lower side of the main body 127*a*' to form an arc shape.

If wash water may run against the bent surface 127*b* through the passage of the main body 127*a*, the wash water spreads out to be evenly sprayed into the drum 124 such that more wash water passes through the laundry.

The first nozzle 127 is not limited to the present invention, but may be implemented in various types that can spray wash water. Also, the first nozzle 127 may be a whirling nozzle shown in FIG. 6.

Figure 8:
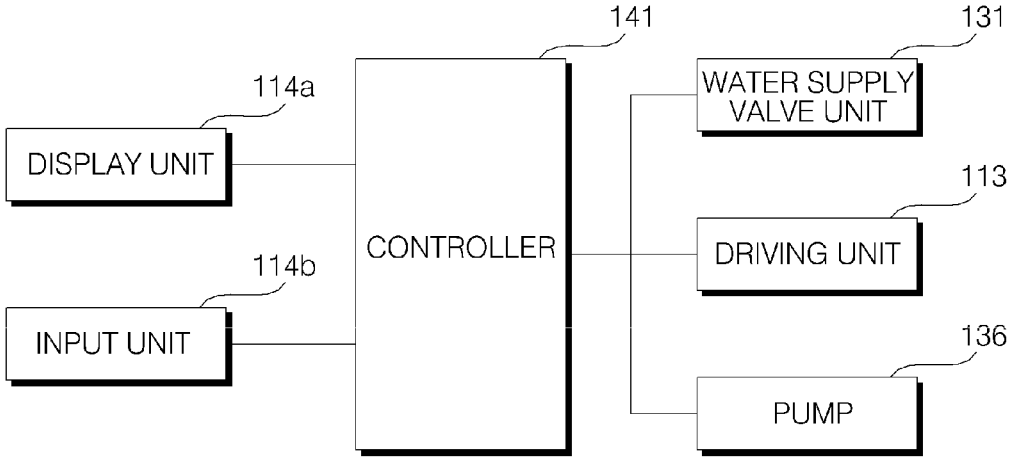
FIG. 8 is a view illustrating a washing machine according to an embodiment of the present invention.

FIG. 8 is a view illustrating a washing machine according to an embodiment.

A controller 141 may control overall operations of a washing machine according to an operation command that an input unit 114*b* has received. The controller 141 may be provided in a control panel 114. A Micom and other electronic components for controlling the operation of the washing machine may be provided. The controller 141 determines whether to perform the respective cycles according to a wash course selected by a user, whether to perform operations such as water supplying, washing, rinsing, draining, spinning and drying, operation time, and the number of cycles, and performs them.

The controller 141 may control a water supply valve unit 131, a driving unit 113, and a pump 136 according to the selected course or other operating commands.

Figure 9:
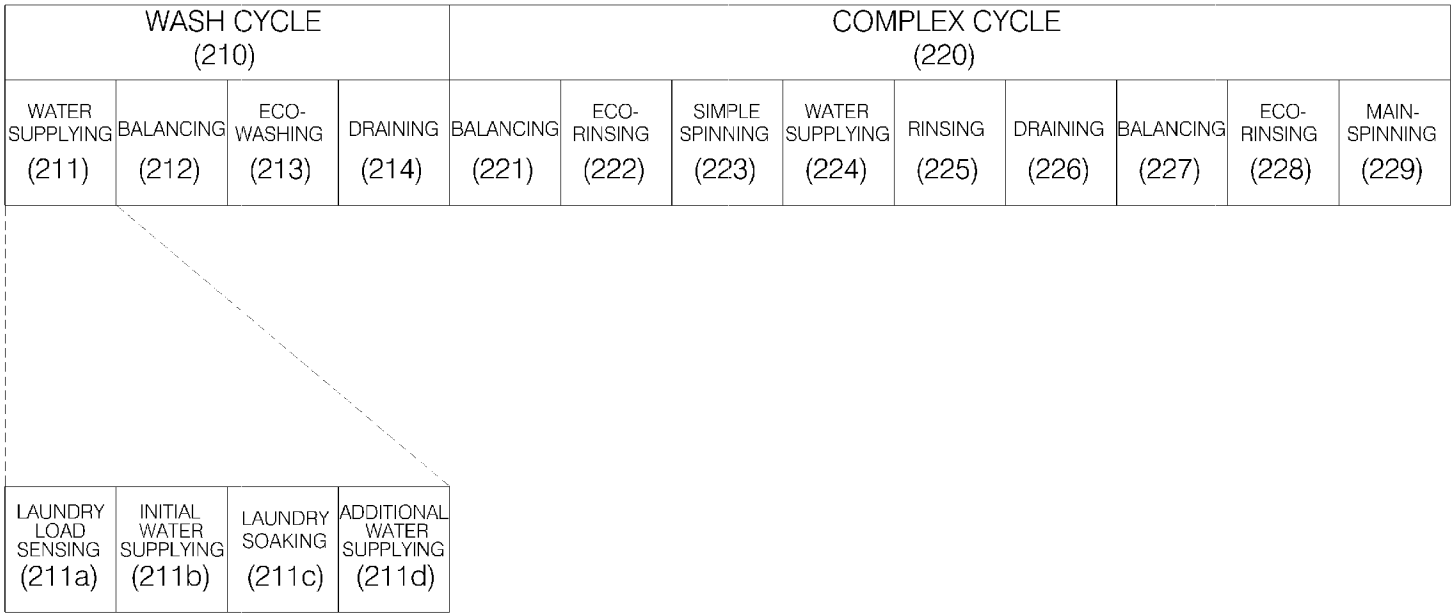
FIG. 9 is a view illustrating the whole cycle of a washing method according to an embodiment of the present invention.
Figure 10:
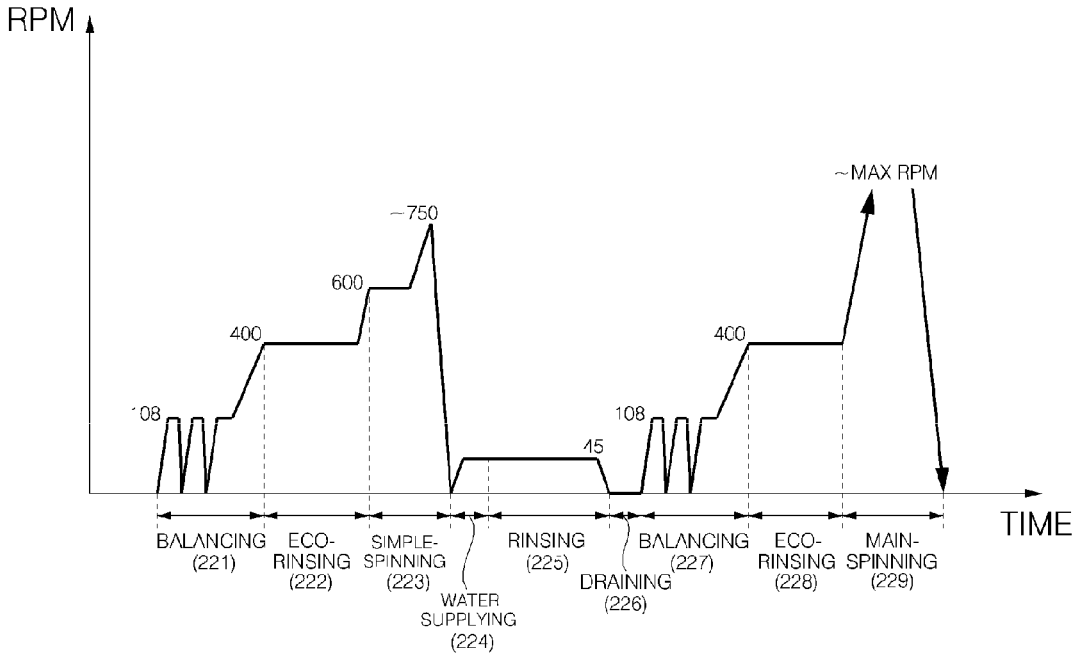
FIG. 10 is a view illustrating a rotational speed of a drum upon complex cycle in the washing method shown in FIG. 9.

FIG. 9 is a view illustrating the whole cycle of a washing method according to an embodiment of the present invention. FIG. 10 is a view illustrating a rotational speed of a drum upon complex cycle in the washing method shown in FIG. 9.

The washing method according to an embodiment of the present invention may be performed when a user selects an energy-saving course through a control panel 114, or an energy-saving course performance command is inputted to the controller 141 according to an input or determination of the user. According to embodiments, a normal washing course may become a washing method described below.

A wash cycle 210 is a cycle of removing contaminants from laundry by rotating a drum 124 after soaking the laundry in wash water mixed with washing detergent. In the washing method according to the embodiment of the present invention, the wash cycle 210 may progress in the order of water supplying 211, balancing 212, eco-washing 213, draining 214, and simple-spinning 215.

If the wash cycle 210 is initiated, the controller 141 may indicate the wash cycle 210 is initiated by displaying a wash icon on a progress display of a display unit 114*a*.

The water supplying 211 is supplying wash water from an external water source to a tub 122. The water supplying 211 includes laundry load sensing 211*a*, initial water supplying 211*b*, laundry soaking 211*c*, and additional water supplying 211*d*.

The laundry load sensing 211*a* is sensing the amount of laundry (hereinafter, referred to as 'laundry load') housed in the drum 124. The laundry load may be measured by various methods. In the present embodiment, the laundry load is measured by a method in which the controller 141 measures deceleration time after the drum 124 is rotated at a certain rate for a certain time.

The longer the deceleration time of the drum 124 is, the higher the level of the laundry load is. According to embodiments, the controller 141 may also measure the acceleration time by calculating the laundry load upon acceleration of the drum 124. The controller 141 determines the amount of wash water supplied into the tub 122 upon initial water supplying 211*b* and additional water supplying 211*d* according to the sensed laundry load, determines the amount of wash water sprayed into the drum 124 upon eco-rinsing 222 and 228 described below, and determines operation time for each cycles.

The initial water supplying 211*b* is supplying wash water mixed with washing detergent into the tub 122 and spraying wash water not mixed with detergent into the drum 124. Upon initial water supplying 211*b*, wash water not mixed with washing detergent may be supplied, and then wash water mixed with washing detergent may be supplied. When the controller 141 opens the pre-valve 131*c* of the water supply valve unit 131, wash water may flow into the tub 122 through the water supply pipe 134 without being mixed with washing detergent in the detergent box 133, and then, when the controller 141 opens the first water supply valve 131*a* of the water supplying valve unit 131, wash water may flow into the tub 122 through the water supply pipe 134 after being mixed with washing detergent in the detergent box 133.

During the initial water supplying 211*b*, while the controller 141 opens the second water supply valve 131*b* to allow wash water not mixed with washing detergent to be sprayed into the drum 124 through the second nozzle 150, the controller 141 may open the first water supply valve 131*a* to allow wash water to be mixed with washing detergent in the detergent box 133, and then flow into the tub 122 through the water supply pipe 134.

In this case, the second nozzle 150, which is a whirling nozzle, may revolve and discharge wash water to the inner wall 124*a* and rear wall 124*b* of the drum 124. The second nozzle 150 changes wash water to whirling water such that wash water undergoes a translational motion and a circular motion, and sprays the whirling water into the drum.

During the initial water supplying 211*b*, the hot water valve of the water supply valve unit 131 may be opened to allow hot water to flow into the tub 122.

The initial water supplying 211*b* is performed until wash water is filled up to a target water level. The target water level is determined by the controller 141 according to a measured laundry load or a selected course prior to the initial water supplying 211*b*. In the present embodiment, the target water level is filled to an extent that the wash water is slightly over the drum 124. Since the laundry is evenly soaked by the wash water sprayed from the second nozzle 150, the water level may not be lowered due to soaking of the laundry in the wash water during the laundry soaking 211*c*. Accordingly, the target water level at which the wash water can be circulated during the laundry soaking 211*c* may be sufficient.

During the initial water supplying 211*b*, the water level of wash water may be measured by the level sensor 121. If wash water is filled in the tub 122 to the target water level, the controller 141 blocks the valve of the water supply valve 131 to finish the initial water supplying 211*b*.

The laundry soaking 211*c* is that the controller 141 drives the driving unit 113 to rotate the drum 124 such that the laundry is evenly soaked in wash water mixed with washing detergent, and the washing detergent is dissolved. During the laundry soaking 211*c*, the controller 141 may operate the pump 136 to allow wash water to circulate along the circulation hose 137 and be sprayed into the drum 124 through the first nozzle 127. In this case, the first nozzle 127 may be a typical spray nozzle or whirling nozzle.

The additional water supplying 211*d* is additionally supplying wash water into the tub 122 up to the target water level because the water level is lowered below the target water level due to soaking of the laundry in wash water. During the addition water supplying 211*d*, when the controller 141 may open various valves including the first water supply valve 131*a*, the second water supply valve 131*b*, or the water supply valve unit 131, wash water is supplied through the water supply pipe 134, or is sprayed through the second nozzle 150 from an external water source. In this case, the second nozzle 150 may be a whirling nozzle, and may generate whirling water to allow wash water to be sprayed on the inner wall 124*a* and the rear wall 124*b* of the drum 124.

When wash water flows into the tub 122 to the target water level, the controller 141 blocks various valves including the first water supply valve 131*a*, the second water supply valve 131*b*, and the water supply valve unit 131 to finish the additional water supplying.

When the laundry is sufficiently soaked during the initial water supplying 211*b*, the water level may not be lowered during the laundry soaking 211*c*. Accordingly, the additional water supplying 211*d* may be omitted.

The balancing 212 is distributing laundry by repeating acceleration, maintenance at a certain rate, and then deceleration of the drum 124. During the eco-washing 213, laundry may be biased to one side due to tangle of the laundry, causing unbalancing of the laundry in which one side of the drum 124 is weighted based on the center of the drum 124. Since the unbalancing of the laundry may cause noise and vibration during the eco-washing 213, the balancing 212 may be required to evenly distribute laundry before the eco-washing 213.

The balancing 212 is performed in a cycle of acceleration, maintenance at a certain rate, and then deceleration of the drum 124 in a state where wash water is housed in the tub 122. During the balancing 212, the drum 124 is accelerated, and is maintained for a certain time at a certain rate such that laundry rotates while being pressed against an inner wall of the drum 124. During the balancing 212, the drum 124 may be maintained at a maximum rate of about 108 RPM such that noise or malfunction is not caused due to the unbalancing of the laundry. During the balancing 212, the drum may be decelerated after being maintained for a certain time at a certain rate such that laundry rotates while being pressed against the inner wall of the drum 124, and then the balancing 212 may be repeated or accelerated to perform the eco-washing 213.

During the balancing 212, the controller 141 measures laundry load, based on the deceleration time of the drum 124 when the drum 124 is decelerated, and measures an unbalanced degree of the laundry, based on a variation of revolutions per minute (RPM) of the drum 124 after the drum 124 is accelerated.

The laundry load is calculated by measuring the deceleration time when the drum 124 is decelerated by the controller 141 as described above. The longer the deceleration time of the drum 124 is, the higher the level of the laundry load is. According to embodiments, the controller 141 may also calculate the laundry load by measuring the acceleration time when the drum 124 is accelerated.

The unbalanced degree of the laundry is calculated according to a variation with respect to the rate of the drum 124 after the drum 124 is accelerated. The rate of the drum 124 is measured using a hole sensor, or is calculated by measuring a current flowing in a motor of the driving unit 113.

The controller 141 determines whether the unbalanced degree of the laundry falls within a tolerance, using a difference between a rate variation and a reference rate variation of the drum 124. The reference rate variation varies according to the laundry load. The controller 141 stores a table of the unbalanced degree of the laundry with respect to the reference rate variation according to the laundry load.

The controller 141 accelerates or decelerates the drum 124 according to the unbalanced degree of the laundry. That is, the controller 141 may adjust the degree of accelerating or decelerating the drum 124 according to the unbalanced degree of the laundry. The controller 141 may also stop the drum 124 when the unbalanced degree of the laundry is excessive.

The controller 141 repeats the acceleration and deceleration of the drum 124 according to the unbalanced degree of the laundry. When the unbalanced degree of the laundry is equal to or greater than the tolerance, the controller 141 continues accelerating and decelerating the drum 124. When the acceleration and deceleration of the drum 124 are continuously repeated because the unbalanced degree of the laundry is equal to or greater than the tolerance, the controller 141 may stop the drum 124. That is, when the acceleration and deceleration of the drum 124 are continuously repeated beyond an allowable number of repetitions, the controller 141 may inform the display unit 114*a* of abnormality, and then may stop the drum 124. When the unbalanced degree of the laundry is within the tolerance, the controller 141 accelerates the drum to perform the eco-washing 213. The balancing 212 described above may be omitted.

During the balancing 212, wash water may be sprayed on laundry through the first nozzle 127 and the second nozzle 150. During the balancing 212, wash water may be sprayed on before laundry is pressed against the inner wall of the drum 124 due to the acceleration of the drum 124. That is, wash water may be sprayed when the drum 124 rotates at a rate of about 45 RPM to about 60 RPM. When the drum 124 rotates at such a rate that laundry is pressed against the inner wall of the drum 124 in a state where wash water is drained during the balancing 212, a laundry film is formed to cause inefficient eco-washing 213. Accordingly, wash water may be sprayed on laundry so as not to form the laundry film.

When wash water is sprayed on laundry through the first nozzle 127, the first water supply valve 131*a* or other valves of the water supply valve unit 131 may be opened to allow wash water not mixed with detergent in the detergent box 133 to flow into the tub 122 through the water supply pipe 124 to such a water level that wash water does not reach the drum 124, and then allow wash water housed in the tub 122 to be discharged by the pump 136, circulate, and then be sprayed through the first nozzle 127.

When wash water is sprayed on laundry through the second nozzle 150, the second water supply valve 131*b* of the water supply valve unit 131 is opened to allow wash water supplied from an external water source to be directly sprayed through the second nozzle 150.

When wash water is sprayed on laundry through the first nozzle 127 or the second nozzle 150, the laundry is soaked by wash water to grow heavier, which prevents a laundry film from being formed.

The eco-washing 213 is removing contaminants from laundry when wash water mixed with washing detergent is supplied in the drum 124 and passes through the laundry in a state where laundry is pressed against the inner wall of the drum 124 due to the rotation of the drum 124. During the eco-washing 213, the controller 141 controls the driving unit 113 to rotate the drum 124 such that the laundry is pressed against the inner wall of the drum 124, and drives the pump 136 to circulate the laundry water along a circulation hose 137. In order to prevent overheat of the driving unit 113 during the eco-washing 214, the controller 141 may stop the driving of the driving unit 113 at an interval of about several seconds or minutes.

Since a physical shock is not applied to the laundry during the eco-washing 213, little damage is caused to the laundry. Accordingly, the eco-washing 213 may be performed when a user selects a laundry damage prevention key or a laundry damage prevention course through the input unit 114*b*.

During the eco-washing 213, the drum 124 rotates at a rate of about 1 or more acceleration of gravity (G) such that the laundry is pressed against the inner wall of the inner wall of the drum 124. The drum 124 may rotate at an appropriate rate such that bubbles are not generated too much during the eco-washing 213. During the eco-washing 213, the drum 124 may rotate at a rate of about 150 RPM.

During the eco-washing 213, the pump may operate to allow the wash water mixed with washing detergent in the tub 122 to circulate along the circulation hose 137 and to be sprayed through a circulation nozzle 127. In this case, the first nozzle 127 may be a typical spray nozzle or a whirling nozzle. When the amount of the circulating wash water is great, bubbles may be generated too much. Accordingly, the amount of the circulating wash water may fit to such a degree that the circulation is possible.

During the eco-washing 213, the controller 141 may open the bleach valve 131*d* of the water supply valve unit 131 to allow wash water to be mixed with bleach in the detergent box 133, and then flow into the tub 122 through the water supply pipe 134. The supplying of bleach is performed until wash water is filled to the target water level. When wash water mixed with bleach flows into the tub 122 to the target level, the controller 141 blocks the bleach valve 131*d* of the water supply valve unit 131. The supplying of wash water mixed with bleach may be performed as a final process of the eco-washing 213 just before the eco-washing 213 is completed.

The draining 214 is discharging the wash water in the tub 122 out of the cabinet 111. During the draining 214, the control unit 141 may operate the pump 136 to allow the wash water in the tub 122 to drain away along a drain hose 138. During the draining 214, the drum 124 may stop, but may maintain at a rate of the eco-washing 213 and also rotate at a rate of 1 G or more such that laundry is pressed against the inner wall of the drum 124.

The balancing 212 and the eco-washing 213 in the wash cycle 210 described above may be performed using a normal washing or squeeze-washing according to a washing course or selection of a user.

The normal washing may be rotating the drum 124 holding laundry soaked in the wash water mixed with washing detergent. During the normal washing, the controller 141 may control the driving unit 113 to rotate the drum 124 at various rates and directions. Thus, mechanical forces such as bending and stretching force, frictional force, and impact force may be applied to remove contaminants from laundry. During the normal washing, the drum 124 rotates in a certain direction at a rate of about 45 RPM, and laundry in the drum 124 is lifted by a lifter 125 and falls. During the normal washing, the controller 141 may stop the driving of the driving unit 113 at an interval of about several seconds or minutes in order to prevent overheat of the driving unit 113.

Steam may be injected into the drum 124 during the normal washing. During the general washing, the controller 141 may operate the pump 136 to allow the wash water to flow into the drum 124 through the first nozzle 127 along the circulation hose 137. In this case, the first nozzle 127 may be a typical spray nozzle or a whirling nozzle.

During the normal washing, the controller 141 may open the bleach valve 131*d* of the water supply valve unit 131 to allow wash water to be mixed with bleach in the detergent box 133, and then flow into the tub 122 through the water supply pipe 134. The supplying of bleach is performed until wash water is filled to the target water level. When wash water mixed with bleach flows into the tub 122 to the target level, the controller 141 blocks the bleach valve 131*d* of the water supply valve unit 131. The supplying of wash water mixed with bleach may be performed as a final process of the normal washing just before the normal washing is completed.

The squeeze-washing is collecting and spreading by varying the RPM of the drum 124 with a rapid cycle. During the squeeze-washing, the RPM of the drum 124 is varied with the rapid cycle from about 50 RPM to about 100 RPM so that the laundry is collected and spreads repeatedly.

During the squeeze-washing, the controller 141 operates the pump 136 such that the wash water flows along the circulation hose 137 and is induced into the drum 124 through the first nozzle 127. At this point, the first nozzle 127 may be a normal spraying nozzle or a whirling nozzle.

During the squeeze-washing, the movement of the laundry is enhanced and thus the washing deviation is reduced. In addition, the laundry evenly contacts the wash water. Further, since the wash water is removed out of the laundry through a squeezing-like action when the laundry is pressed against the inner wall of the drum, the dirt can be removed from the laundry through the squeeze-like motion. In addition, since the laundry is pressed against or detached from the inner wall of the drum repeatedly, the user can visually identify the movement of the laundry.

At least one of the eco-washing 213, normal washing, and squeeze-washing may be performed according to the washing course or user selection.

The complex cycle 220 is for removing the remaining detergent and wash water from the laundry. In the normal washing method, the complex cycle includes the rinse cycle and the spin cycle. In the washing method of this embodiment, the complex cycle 220 includes the balancing 221, eco-rinsing 222, simple-spinning 223, water supplying 224, rinsing 225, draining 226, balancing 227, eco-rinsing 228, and main-spinning 229. When the complex cycle 220 starts, the controller 141 may display an icon "rinsing" and/or "spinning" as a proceeding display on the display unit 114*a*.

Like the balancing 212 in the wash cycle 210, the balancing 221 repeats the acceleration, maintenance of constant RPM, and RPM reduction of the drum 124 to disperse evenly the laundry. In the eco-rinsing 222, the laundry may be sided in a direction by the tangling of the laundry. This causes the unbalancing of the laundry, whereby the weight of the drum is sided in a direction with reference to the center of the drum. The unbalancing of the laundry causes the noise and vibration when the drum 124 rotates at the high RPM and thus the laundry is evenly dispersed before performing the eco-rinsing.

As shown in FIG. 10, in the balancing 221, the acceleration, maintenance of the constant RPM, and RPM reduction of the drum becomes one cycle. In the balancing 221, after the drum 124 is accelerated, the RPM at which the laundry is pressed against the inner wall of the drum 124 and rotates together with the drum 124 is maintained for a predetermined time. In the balancing 221, the drum 124 maintains about 108 RPM at which the unbalancing of the laundry is not incurred and thus no noise and no breakdown occur. After maintaining the RPM at which the laundry is pressed against the inner wall of the drum 124 for a predetermined time, the RPM of the drum is reduced, after which the balancing 212 is repeated or the drum is accelerated to perform the eco-rinsing 222.

In the balancing 221, the controller 141 measures the amount of the laundry based on the RPM reduction time when the RPM of the drum 124 is reduced and measures the amount of the unbalancing of the laundry based on the variation of the RPM after the drum is accelerated. The method for measuring the amounts of the laundry and unbalancing of the laundry is same as that in the balancing 212 of the wash cycle 210.

As described above, in the balancing 221, the wash water is sprayed toward the laundry through the first nozzle 127 or the second nozzle 150.

In the eco-rinsing 222, when the laundry is pressed against the inner wall of the drum 124 and rotates together with the drum 124 by the rotation of the drum 124, the wash water that is not mixed with the detergent is sprayed into the drum 124 and passes through the laundry, thereby removing the remaining detergent and dirt from the laundry. In the eco-rinsing 222, the controller 141 controls the driving unit 113 such that the drum 124 rotates so that the laundry is pressed against the inner wall of the drum 124 and opens the second water supply valve 131*b* to spray the wash water into the drum 124 through the second nozzle 150. At this point, the controller 141 operates the pump 136 so that the wash water in the tub 122 can be drained to the external side along the drain hose 138.

In the eco-rinsing 222, the second nozzle 150 may be the whirling nozzle that revolves and discharges the wash water to the inner and rear walls 124*a* and 124*b* of the drum 124. In order for the wash water to perform translation motion and circular motion, the second nozzle 150 converts the wash water into the whirling water and sprays the whirling water into the drum 124.

According to an embodiment, the first water supply valve 131*a* of the water supply valve unit 131 or another valve is opened to supply the wash water that is not mixed with the detergent into the tub 122 through the water supply pipe 134 up to a height at which the supplied wash water does not contact the drum 124 or the second water supply valve 131*b* of the water supply valve unit 131 is opened to supply the wash water into the tub 122 through the second nozzle 150 up to a height at which the supplied wash water does not contact the drum 124, after which the wash water contained in the tub 122 is discharged and circulated by the pump 136 and sprayed through the first nozzle 127. At this point, the first nozzle 127 may be the normal spraying nozzle or the whirling nozzle. When the circulated wash water is sprayed through the first nozzle 127, the wash water in the tub 122 is not drained to the external side along the drain hose 138.

In the eco-rinsing 222, the drum 124 rotates at 1 G (i.e., above about 108 RPM at which the laundry is pressed against the inner wall of the drum 124 and rotates together with the drum 124). In the eco-rinsing 222, the laundry may be pressed against the inner wall of the drum 124. At this point, the pressing of the laundry against the inner wall of the drum 124 includes a means that at least a portion of the laundry is pressed against the inner wall of the drum 124. That is, most of the laundry is pressed against the inner wall of the drum 124.

In the eco-rinsing 222, the drum 124 may maintain about 400 RPM. In the eco-rinsing 222, the drum may be accelerated to about 600 RPM. Before the drum is accelerated to about 600 RPM and the simple-spinning 223 is performed, the wash water that is not mixed with the detergent may be sprayed into the drum.

The eco-rinsing 222 will be described in more detail with reference to FIG. 11 later.

In the simple-spinning 223, the drum 124 rotates at a high RPM so that the wash water can be removed out of the laundry. After the eco-rinsing 222, the controller 141 continuously rotates the drum 124 at an RPM higher than an RPM at which the laundry is pressed against the inner wall of the drum 124 and rotates together with the drum 124. The controller 141 closes the second water supply valve 131*b* to stop spraying the water and accelerates the drum 124.

Hereinafter, the term "continuously" means that the drum 124 rotates without stopping between the respective cycles and includes the RPM variation of the drum 124 by accelerating or reducing the RPM of the drum 124.

According to an embodiment, the controller 141 performs the simple-spinning 223 by accelerating the drum 124 after stopping spraying the wash water by closing the second water supply valve 131*b* after draining the water by operating the pump 136 without reducing the RPM of the drum 124.

Since there is no need to remove the water out of the laundry to a level that the laundry is dried, it is desirable to rotate the drum 124 at about 750 RPM.

In the simple-spinning 223, it is desirable that the controller 141 intermittently operates the pump 136 to drain the wash water in the tub 122 to an external side. As described in the above-described embodiment, the pump 136 operates for a predetermined time to drain the wash water in the tub 122 to the external side before the drum is accelerated and thus rotates at a high RPM. At this point, the drum 124 may maintain an RPM higher than an RPM at which the laundry is pressed against the inner wall of the drum 124 and rotates together with the drum 124. The drum may maintain an RPM of the eco-rinsing 222. Since the wash water in the tub 122 is drained to the external side before the drum 124 rotates at the high RPM, the breakdown of the washing machine can be prevented.

The simple-spinning 223, the balancing is not performed between the eco-rinsing 222 and the simple-spinning 223 by accelerating the drum 124 without stopping the drum 124 in the eco-rinsing 222. That is, the eco-rinsing 222 and the simple-spinning 223 are continuously performed without the balancing, whereby the whole washing time can be reduced and the damage of the laundry can be reduced.

According to an embodiment, the drum 124 may maintain an RPM higher than an RPM at which the laundry is pressed against the inner wall of the drum 124 and rotates together with the drum 124 so that no balancing is required even when the RPM of the drum 124 is reduced between the eco-rinsing 22 and the simple-spinning 223. That is, the drum may rotate at 1 G (i.e., above about 108 RPM at which the laundry is pressed against the inner wall of the drum 124 and rotates together with the drum 124) from the eco-rinsing 222 to the simple-spinning 223 so that the laundry is not detached from the drum 124. In other words, the laundry remains pressed against the inner wall of the drum 124 from the eco-rinsing 222 to the simple-spinning 223.

Like the water supplying 211 in the wash cycle 210, the water supply 224 is performed to supply the wash water from the outer water source into the tub 122. The water supplying 224 includes initial water supplying, laundry soaking, and additional water supply.

In the water supplying 224, the controller 141 opens the first water supply valve 131*a* and the free valve so that the wash water can be supplied to the tub 122 through the water supply pipe 134 after being mixed with a rinsing detergent in the detergent box 133.

According to an embodiment, in the water supplying 224, the second water supply valve 131*b* is opened to spray the wash water that is not mixed with the detergent into the drum 124 through the second nozzle 150 or the pump 136 is operated to spray the wash water flowing along the circulation hose 137 into the drum 124 through the first nozzle 127.

Although the drum 124 may be stopped in the water supplying 224, the water supplying 224 may be preformed after the RPM of the drum 124 is reduced to 1 G (i.e., about 108 RPM that is an balancing RPM) at which the laundry is pressed against the inner wall of the drum 124 and rotates together with the drum 124 after the simple-spinning 223.

In the rinsing 225, the drum 124 in which the laundry soaked in the wash water mixed with the rinsing detergent rotates. In the rinsing 225, the controller 141 controls the drum 124 such that the drum 124 rotates in a variety of RPMs and a variety of directions so that the laundry can repeatedly be lifted and falls, thereby applying bending force, frictional force, and impact force to the laundry and thus removing remaining detergent and dirt from the laundry. In the rinsing 225, the controller 141 may operate the pump 136 so that the wash water flows along the circulation hose 137 and is sprayed into the drum 124 through the first nozzle 127. At this point, the first nozzle 127 may be a normal spraying nozzle or a whirling nozzle.

Like the draining 214 in the wash cycle 210, the draining 214 is for draining the wash water in the tub 122 out of the cabinet 111.

The water supplying 224, rinsing 225, and draining 226 may be modified or omitted. The water supplying 224, rinsing 225, and draining 226 may be performed without stopping the drum 124 that is reduced in the RPM after the simple-spinning 223. In this case, balancing 227 that will be described below may be omitted.

Like the balancing 221 described above, the balancing 227 is for evenly dispersing the laundry by repeating the acceleration, maintaining of the constant RPM, and reduction of the RPM of the drum. As described above, in the balancing 227, the wash water is sprayed toward the laundry through the first nozzle 127 or the second nozzle 150.

As described above, in each balancing 212, 221, and 227, since the wash water is sprayed toward the laundry through the first nozzle 127 or the second nozzle 150, the forming of a laundry film can be prevented. After the balancing 212, 221, and 227, the drum 124 rotates at 1 G (i.e., an RPM greater than about 108 RPM at which the laundry is pressed against the inner wall of the drum 124 and rotates together with the drum 124) and one of the eco-washing 213 and eco-rinsing 222 and 228 is performed.

In addition, according to an embodiment, after the balancing 212, 221, and 227, the simple-spinning or main-spinning may be performed.

Like in the eco-rinsing 222 described above, in the eco-rinsing 228, the drum 124 rotates and the wash water that is not mixed with detergent is sprayed into the drum to which the laundry is pressed, whereby the wash water passes through the laundry to remove the remaining detergent and dirt from the laundry.

In the eco-rinsing 228, the drum 124 rotates at 1 G (i.e., an RPM greater than about 108 RPM at which the laundry is pressed against the inner wall of the drum 124 and rotates together with the drum 124). In the eco-rinsing 228, it is desirable that the laundry is not detached from the drum 124.

In the complex cycle 220, at least one of the eco-rinsing 222, rinsing 225, and eco-rinsing 228 may be performed as squeeze-rinsing according to a washing course or user selection or the squeeze-rinsing may be added to the complex cycle 220.

In the squeeze-rinsing, the drum 124 rotates at a high RPM to collect or spread the laundry. In the squeeze-rinsing, the drum 124 varies at a rapid period from about 50 RPM to about 100 RPM so that the laundry 124 can be repeatedly pressed against or detached from an inner wall of the drum 124.

In the squeeze-rinsing, the controller 141 operates the pump 136 so that the wash water flows along the circulation hose 137 and can be induced into the drum 124 through the first nozzle 127. At this point, the first nozzle 127 may be a normal spraying nozzle or a whirling nozzle.

In the squeeze-rinsing, the movement of the laundry is enhanced and thus the wash deviation of the laundry is reduced. In addition, the laundry and wash water contact evenly each other. In addition, when the laundry is pressed against the inner wall of the drum, the wash water absorbed in the laundry is removed from the laundry by a squeezing-like action. Therefore, the remaining detergent can be removed from the laundry by the squeezing-like action. In addition, since the laundry is repeatedly pressed against and detached from the inner wall of the drum, the user can visually identify the movement of the laundry.

Like the simple-spinning 223, the main-spinning 229 is for removing the wash water out of the laundry by rotating the drum 124 at a high RPM. After the eco-rinsing 228, the controller 141 continuously rotates the drum 124 at an RPM higher than an RPM at which the laundry is pressed against the inner wall of the drum 124 and rotates together with the drum 124. In addition, the controller 141 closes the second water supply valve 131*b* to stop the spraying of the wash water and accelerates the drum 124. According to an embodiment, the controller 141 closes the second water supply valve to stop the spraying of the wash water at the end of the eco-rinsing 228, after which the controller 141 operates the pump 136 to drain the wash water without reducing the RPM of the drum 124. Next, the drum 124 accelerates the drum 124 to perform the main-spinning 229.

In order to remove the wash water out of the laundry as much as possible, the controller 141 may rotates the drum 124 at a maximum RPM of about 1000 RPM or higher.

In the main-spinning 229, the controller 141 may drain the wash water in the tub 122 to the external side along the drain hose 138 by intermittently operating the pump 136. According to an embodiment, before the drum 124 is accelerated to rotate at the high RPM, the pump 136 operates for a predetermined time to drain the wash water in the tub to the external side along the drain hose 138. At this point, the drum 124 may maintain the RPM higher than the RPM at which the laundry is pressed against the inner wall of the drum 124 and rotates together with the drum 124. Before the drum 124 rotates at the high RPM, the wash water in the tub 122 is drained and thus the breakdown of the washing machine can be prevented.

In the main-spinning 229, no balancing is specially performed between the eco-rinsing 228 and the main-spinning 229 by accelerating the drum 124 of the eco-rinsing 228 without stopping the drum 124 or reducing the RPM of the drum 124. The eco-rinsing 228 and the main-spinning 229 are continuously performed without the balancing, the whole washing time can be reduced and the damage of the laundry can be reduced.

According to an embodiment, in order for the balancing not to be necessary even when the RPM of the drum 124 is reduced between the eco-rinsing 228 and the main-spinning 229, the drum 124 may maintain the RPM higher that the RPM at which the laundry is pressed against the inner wall of the drum 124 and rotates together with the drum 124. That is, the drum may rotate at 1 G (i.e., above about 108 RPM at which the laundry is pressed against the inner wall of the drum 124 and rotates together with the drum 124) from the eco-rinsing 228 to the main-spinning 229 so that the laundry is not detached from the drum 124. In other words, the laundry remains pressed against the inner wall of the drum 124 from the eco-rinsing 228 to the main-spinning 229.

After the main-spinning 229, drying where hot wind is supplied into the drum 124 to dry the laundry may be performed.

The above-described complex cycle 220 may be modified or omitted.

Figure 11:
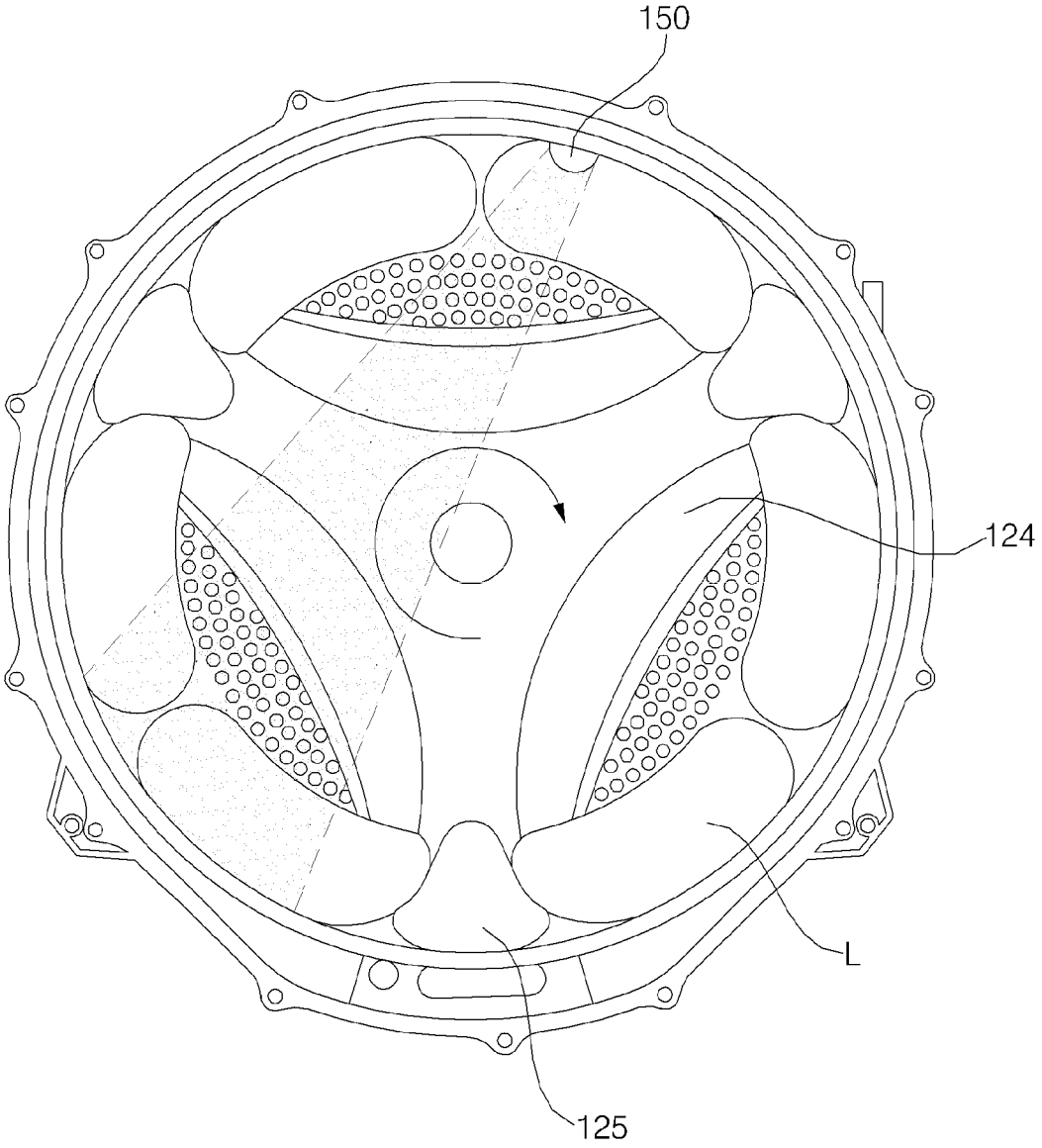
FIG. 11 is a view illustrating eco-rinsing of a washing method according to an embodiment of the present invention.

FIG. 11 is a view illustrating eco-rinsing of a washing method according to an embodiment of the present invention.

Referring to FIG. 11, when the drum 124 rotates in the eco-rinsing 222, 228 such that the laundry L is pressed against the inner wall of the drum 124, the second water supply valve 131*b* is opened to supply the wash water to the drum 124 through the second nozzle 150.

The drum 124 may rotate at about 400 RPM. The second nozzle 150 may spray the wash water to an area of the inner and rear walls 124*a* and 124*b* of the drum 124. The remaining detergent and dirt are removed from the laundry as the sprayed wash water passes through the laundry L.

The controller 141 may operate the pump 136 to drain the wash water in the tub 122 to the external side along the drain hose 138.

Figure 12:
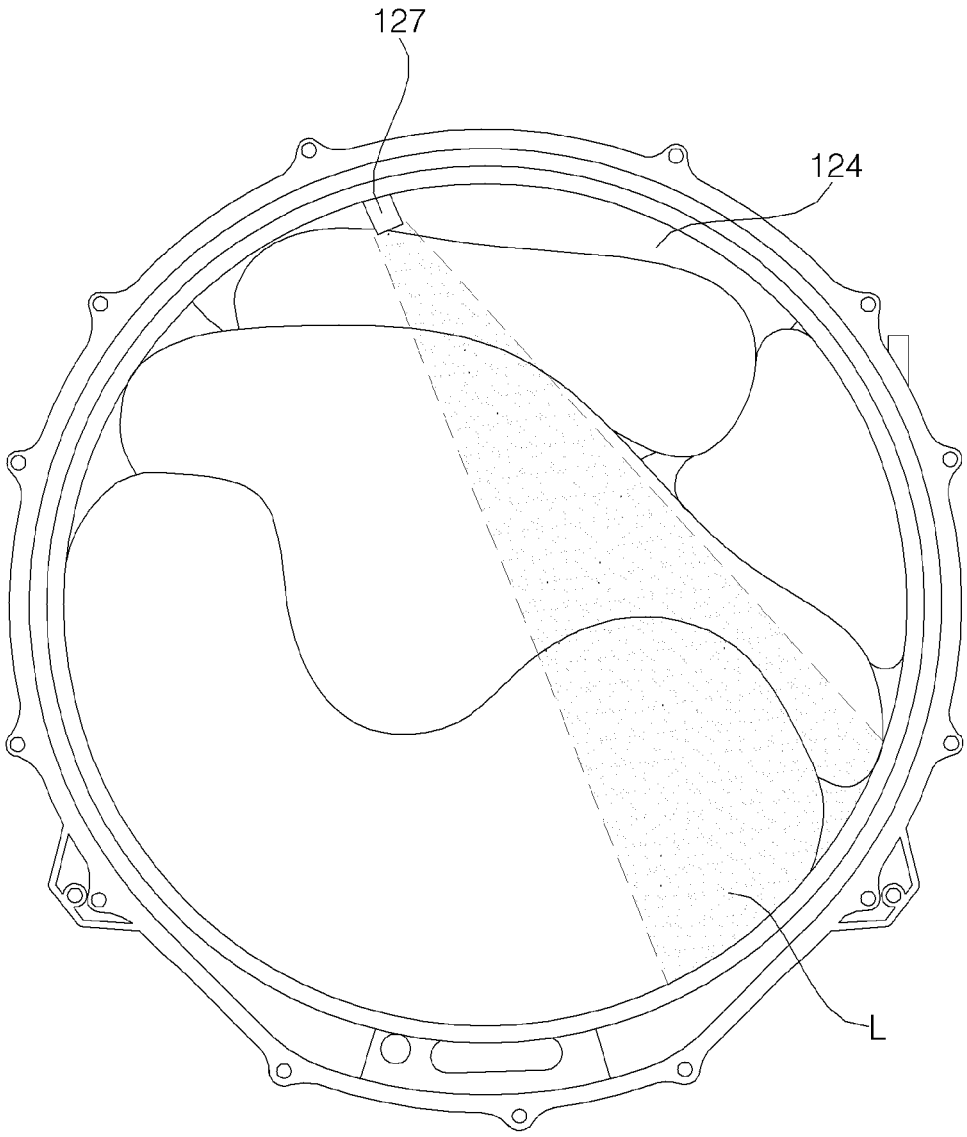
FIG. 12 is a view illustrating spraying of the wash water from the first nozzle in the balancing of the washing method according to an embodiment of the present invention.

FIG. 12 is a view illustrating spraying of the wash water from the first nozzle in the balancing of the washing method according to an embodiment of the present invention.

In the balancing 212, 221, 227, the first water supply valve 131*a* of the water supply valve unit 131 or another valve is opened to supply the wash water that is not mixed with the detergent into the tub 122 through the first nozzle 127 up to a height at which the supplied wash water does not contact the drum 124, after which the wash water contained in the tub 122 is discharged and circulated by the pump 136 and sprayed through the first nozzle 127.

In the balancing 212, 221, 227, the wash water may be sprayed toward the laundry through the first nozzle 127 before the laundry L is pressed against the inner wall of the drum 124 by the acceleration of the drum 124. That is, the wash water may be sprayed when the drum 124 rotates at an RPM of about 45-60 RPM. When the wash water is sprayed to the laundry L through the first nozzle 127, the laundry is soaked in the wash water to get weight, thereby preventing the forming of the laundry film.

Figure 13:
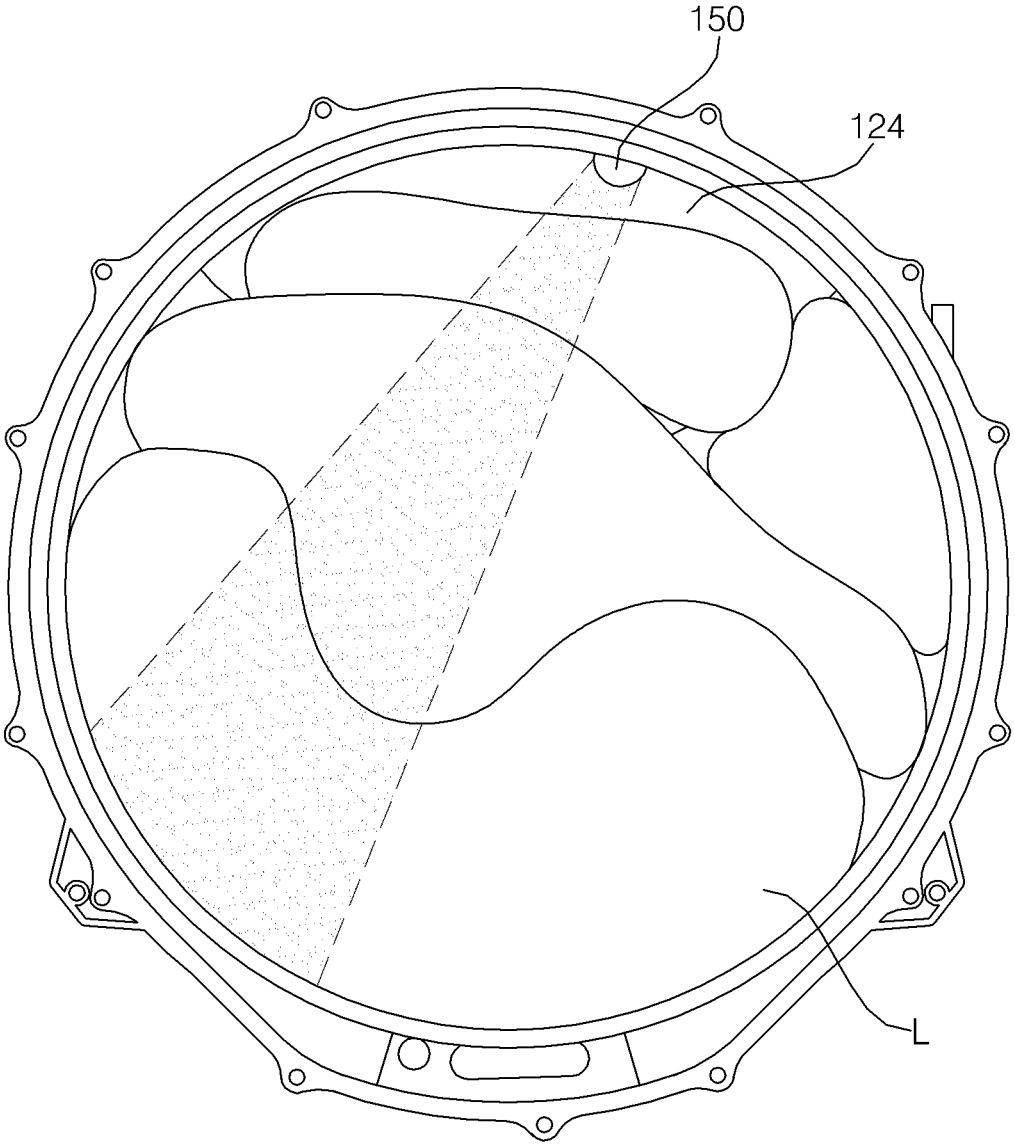
FIG. 13 is a view illustrating spraying of the wash water through the second nozzle in the balancing of the washing method according to an embodiment of the present invention.

FIG. 13 is a view illustrating spraying of the wash water through the second nozzle in the balancing of the washing method according to an embodiment of the present invention.

In the balancing 212, 221, 227, the second water supply valve 131*b* of the water supply valve unit 131 to directly spray the wash water supplied from the outer water source toward the laundry L through the second nozzle 150.

In the balancing 212, 221, 227, the wash water may be sprayed toward the laundry through the second nozzle 150 before the drum 124 is accelerated and thus the laundry L is pressed against the inner wall of the drum.

Figure 14:
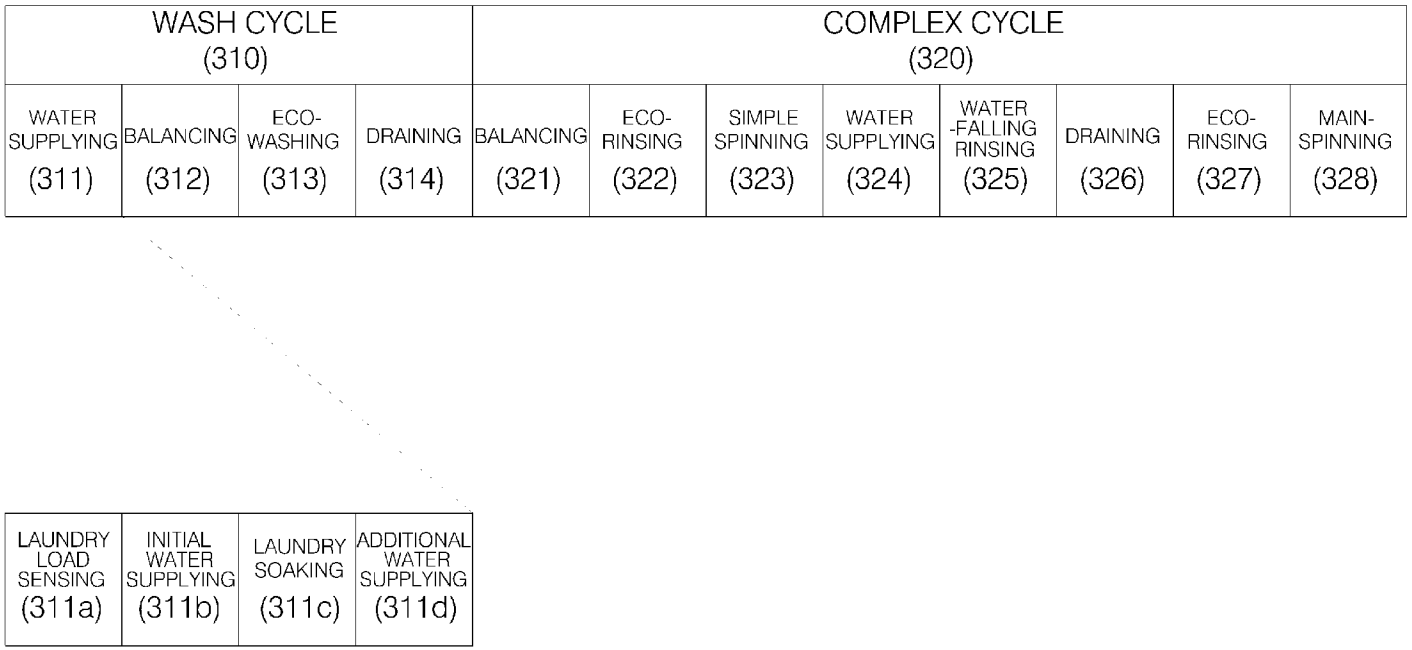
FIG. 14 is a view illustrating a whole cycle of a washing method according to another embodiment of the present invention.
Figure 15:
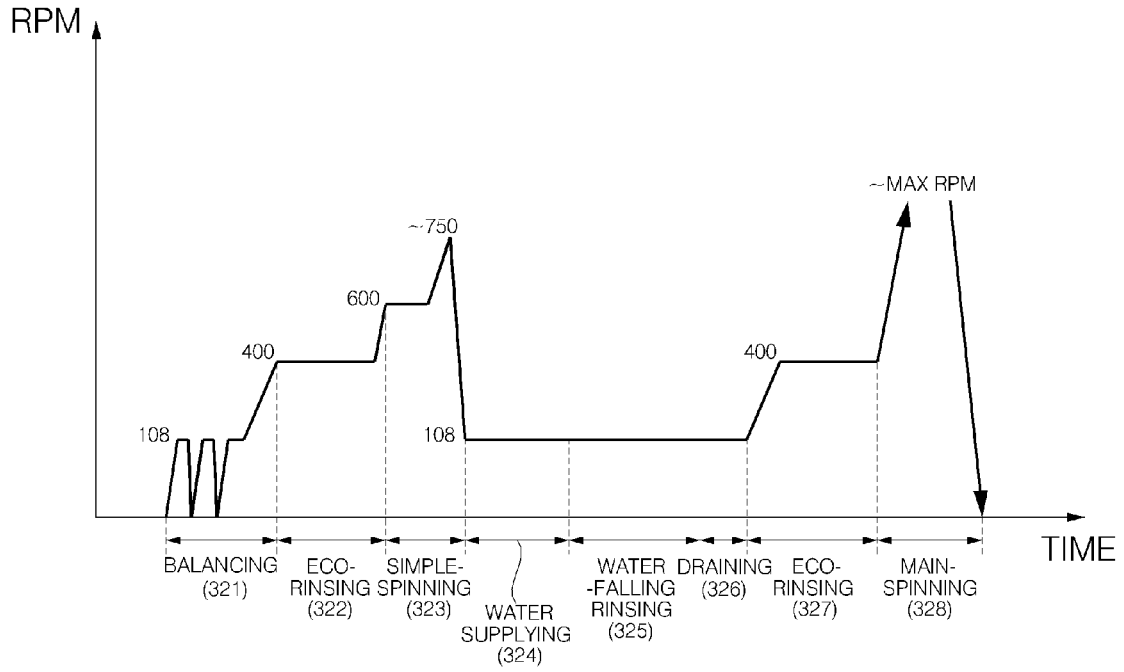
FIG. 15 is a view illustrating an RPM of a drum in a complex cycle in the washing method illustrated in FIG. 14.

FIG. 14 is a view illustrating a whole cycle of a washing method according to another embodiment of the present invention, and FIG. 15 is a view illustrating an RPM of a drum in a complex cycle in the washing method illustrated in FIG. 14.

A washing method according to another embodiment of the present invention may be used when a user selects an energy-saving course through the control panel 114 or an energy-saving course command is input to the controller according to the user's input or determination. In addition, according to an embodiment, a normal washing course may be a washing method that will be described below.

The complex cycle 320 of the washing method of this embodiment includes balancing 321, eco-rinsing 322, simple-spinning 323, water supplying 324, water-falling rinsing 325, draining 326, eco-rinsing 327, and main-spinning 328.

Only the difference from the washing method of the foregoing embodiment of FIGS. 9 and 10 will be described hereinafter.

In the water supplying 324, the wash water is supplied from an outer water source into the tub 122. In the water supplying 324 after the simple-spinning 323, the RPM of the drum 124 may be reduced such that the drum 124 rotates at 1 G (i.e., above about 108 RPM that is balancing speed at which the laundry is pressed against the inner wall of the drum 124 and rotates together with the drum 124).

In the water supplying 324, the controller 141 opens the first water supply valve 131*a* and free valve to mix the wash water with a rinsing detergent and supply the wash water mixed with the rinsing detergent into the tub 122 through the water supply pipe 134.

In the water-falling rinsing 325, the drum 124 in which the laundry soaked in the wash water mixed with the rinsing detergent is loaded rotates. In the water-falling rinsing 325, the controller 141 controls the driving unit 113 such that the drum 124 rotates at 1 G (i.e., above about 108 RPM that is balancing speed at which the laundry is pressed against the inner wall of the drum 124 and rotates together with the drum 124). In the water-falling rinsing 325, the laundry may be pressed against the inner wall of the drum 124. In the water-falling rinsing 325, the drum may maintain about 108 RPM that is an RPM of the water supplying 324.

In the water-falling rinsing 325, the controller 141 may operate the pump 136 so that the wash water flows along the circulation hose 137 and is sprayed into the drum 124 through the first nozzle 127.

The draining 326 is for draining the wash water in the tub 122 out of the cabinet 111. In the draining 326, the controller 141 controls the driving unit 113 such that the drum 124 rotates at 1 G (i.e., above about 108 RPM that is balancing speed at which the laundry is pressed against the inner wall of the drum 124 and rotates together with the drum 124). In the draining 326, the laundry may be pressed against the inner wall of the drum 124. In the draining 326, the drum 124 may maintain the 108 RPM that is the RPM in the water-falling rinsing 325.

The simple-spinning 323, water supplying 324, water-falling rinsing 325, and draining 326 that are performed between the first eco-rinsing 322 and the second eco-rinsing 327 may be referred to as an intermediating process. In the intermediating process, although the RPM of the drum 124 may be increased or reduced in the intermediating process, the drum 124 may rotate at 1 G (i.e., above about 108 RPM that is balancing speed at which the laundry is pressed against the inner wall of the drum 124 and rotates together with the drum 124) so that no balancing is performed. That is, in the intermediating process, the laundry may be pressed against the inner wall of the drum 124.

In the intermediating process, at least one of the simple-spinning 323, water supplying 324, water-falling rinsing 325, and draining 326 may be performed.

That is, in the intermediating process, the drum 124 rotates at 1 G (i.e., above about 108 RPM that is balancing speed at which the laundry is pressed against the inner wall of the drum 124 and rotates together with the drum 124). In addition, in the intermediating process, the wash water may be removed out of the laundry, the wash water mixed with the rinsing detergent may be supplied into the drum 124, or the wash water may circulate and be sprayed into the drum 124.

In the intermediating process, at least one of the eco-washing, normal-washing, squeeze-washing, squeeze-rinsing, and steam-spraying may be preformed or the drum 124 may rotate at 1 G (i.e., above about 108 RPM that is balancing speed at which the laundry is pressed against the inner wall of the drum 124 and rotates together with the drum 124) to perform a variety of processes performed in the washing machine.

The first eco-rinsing 322, intermediating process, and second eco-rinsing 327 may be continuously performed without performing the balancing. The drum 124 may maintain the RPM higher than the RPM at which the laundry is pressed against the inner wall of the drum 124 so that no balancing is needed even when the RPM of the drum 124 is reduced between the eco-rinsing 322, intermediating process, and second eco-rinsing 327.

The drum 124 may rotate at 1 G (i.e., above about 108 RPM that is balancing speed at which the laundry is pressed against the inner wall of the drum 124 and rotates together with the drum 124) until the main-spinning 328 is performed through the first eco-rinsing 322, intermediating process, and second eco-rinsing 327. That is, the laundry remains pressed against the inner wall of the drum 124 from the eco-rinsing 322 to the main-spinning 328.

The washing method and machine of the present invention has following effects.

First, since the eco-rinsing is performed before starting the spinning, the cycle performing time can be reduced and the damage of the laundry can be reduced.

Second, since the eco-rinsing is performed before starting the spinning, the remaining detergent can be effectively removed even by performing the rinsing once.

Third, since the spinning is performed by accelerating the drum without stopping the drum or reducing the RPM of the drum in the eco-rinsing, no balancing is specially needed, thereby reducing the whole washing time and the damage of the laundry.

Fourth, the wash water can be effectively sprayed in the eco-rinsing.

Fifth, since the forming of the laundry film is prevented before performing the eco-rinsing, the eco-rinsing can be effectively realized.

Sixth, since the wash water is sprayed in the balancing before performing the eco-rinsing, the laundry film can be effectively prevented.

Seventh, since the rinsing is performing without stopping the drum in the spinning after performing the eco-rinsing and thus no balancing is performed before performing the second eco-rinsing, the whole cycle time is reduced and the damage of the laundry can be reduced.

The effects of the present invention are not limited to the effects described above, and other effects that have not been set forth herein will be clearly understood from the appended claims by those skilled in the art.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A laundry machine comprising:

a cabinet;

a tub within the cabinet;

a drum rotatably arranged in the tub, wherein the drum includes a plurality of holes to allow water to pass therethrough;

a first nozzle to introduce the water to the drum;

a water supply line to supply the water from a water supply source to the first nozzle;

a detergent box coupled to the water supply line;

a water supply hose coupled to the detergent box to allow the water mixed with at least one content of the detergent box to flow from the detergent box to the tub;

a drain to drain the tub;

a driving unit to rotate the drum;

a second nozzle;

a pump;

a controller configured to perform a balancing process, wherein the controller causes the driving unit to rotate the drum such that laundry attaches to the drum and becomes balanced within the drum, the controller configured to perform a first rinsing process, wherein the controller causes the water supply line to supply the water to the first nozzle, thereby causing the first nozzle to introduce the water to the drum in a form of a spray, while the drum is rotated such that the laundry remains attached to the drum and rotates with the drum, the controller configured to perform a spinning process after performing the first rinsing process, wherein the controller causes the driving unit to rotate the drum at a revolutions per minute (RPM) higher than a RPM of the first rinsing process while causing the drain to drain the tub, the controller preventing the water supply line from supplying water to the first nozzle, the controller configured to perform a water supplying process after performing the spinning, the controller causes the water supply line to supply the water to the detergent box to be mixed with the at least one content of the detergent box, thereby the water mixed with the at least one content of the detergent box to flow from the detergent box to the tub through the water supply hose, while causing the driving unit to rotate the drum at a RPM higher than or equal to a RPM at which the laundry is attached to the drum and rotates with the drum and lower than the RPM of the first rinsing process, the controller configured to perform a water-falling rinsing process after performing the water supplying process, wherein the controller causes the pump to pump the water mixed with the at least one content of the detergent box from the tub to the second nozzle, thereby causing the second nozzle to introduce the water mixed with the at least one content of the detergent to the drum in the form of the spray, while causing the driving unit to rotate the drum at a RPM higher than or equal to the RPM at which the laundry is attached to the drum and rotates with the drum, the controller configured to perform a draining process after performing the water-falling rinsing process, wherein the controller causes the drain to drain the tub while causing the driving unit to rotate the drum at a RPM higher than equal to the RPM at which the laundry is attached to the drum and rotates with the drum, the controller configured to perform a second rinsing process after performing the draining process, the controller causes the water supply line to supply the water to the first nozzle, thereby causing the first nozzle to introduce the water to the drum in a form of a spray, while causing the driving unit to rotate the drum at a RPM higher than the RPM of the draining process such that the laundry is attached to the drum and rotates with the drum, wherein between the first rinsing process, the spinning process, the water supplying process, the water-falling rinsing process, the draining process, and the second rinsing process, the controller configured to cause the driving unit to rotates the drum continuously.

2. The laundry machine of claim 1, wherein the first nozzle causes the water flowing therethrough to undergo a translational and a circular motion.

3. The laundry machine of claim 1, wherein the first nozzle causes the water flowing therethrough to become atomized.

4. The laundry machine of claim 1, wherein the first nozzle comprises:

a housing having a receiving space therein; and a core provided in the receiving space and formed of a twisted plate to form a plurality of twisted flow paths together with the receiving space wherein the wash water passing through the plurality of twisted flow paths is changed to the whirling water.

5. The laundry machine of claim 1, wherein the first nozzle is coupled to the water supply line at a point before the water supply line is coupled to the detergent box.

6. The laundry machine of claim 1, wherein, during the spinning process, the controller intermittently causes the drain to drain the tub before the controller causes the driving unit to accelerate the rotation of the drum.

7. The laundry machine of claim 1, wherein the controller balances the laundry within the drum by causing the driving unit to accelerate the rotational speed of the drum, rotate the drum at a predetermined speed, and decelerate the rotational speed of the drum.

8. The laundry machine of claim 1, wherein before the balancing of the laundry, the controller causes the first nozzle to introduce the water to the drum before the laundry attaches to the drum in order to prevent a laundry film.

9. The laundry machine of claim 1, wherein the first nozzle introduces water to at least a portion of an inner surface and a portion of a rear surface of the drum.

10. The laundry machine of claim 9, wherein the first nozzle introduces water to an entire inner surface of the drum and a portion of the rear surface of the drum.

11. The laundry machine of claim 9, wherein the first nozzle introduces water to an entire inner surface of the drum and an entire rear surface of the drum.

* * * * *